US005478717A

United States Patent [19]

Ikeda et al.

[11] Patent Number: 5,478,717

[45] Date of Patent: Dec. 26, 1995

[54] SILVER HALIDE EMULSION AND PHOTOGRAPHIC LIGHT-SENSITIVE MATERIAL USING THE SAME

[75] Inventors: Hideo Ikeda; Takefumi Hara, both of Minami-Ashigara, Japan

[73] Assignee: Fuji Photo Film Co., Ltd., Kanagawa, Japan

[21] Appl. No.: 370,477

[22] Filed: Jan. 9, 1995

Related U.S. Application Data

[63] Continuation of Ser. No. 137,808, Oct. 19, 1993, abandoned, which is a continuation of Ser. No. 789,852, Nov. 8, 1991, abandoned.

[30] Foreign Application Priority Data

Nov. 16, 1990 [JP] Japan ..... 2-310862

[51] Int. Cl.[6] ..... G03C 1/035

[52] U.S. Cl. ..... 430/567; 430/569

[58] Field of Search ..... 430/567, 569

[56] References Cited

U.S. PATENT DOCUMENTS

| | | | |
|---|---|---|---|
| 4,414,306 | 11/1983 | Wey et al. | 430/567 |
| 4,414,310 | 11/1983 | Daubendiek et al. | 430/567 |
| 4,433,048 | 2/1984 | Solberg et al. | 430/567 |
| 4,434,226 | 2/1984 | Wilgus et al. | 430/567 |
| 4,439,520 | 3/1984 | Kofron et al. | 430/567 |
| 4,459,353 | 7/1984 | Maskasky | 430/567 |
| 4,665,012 | 5/1987 | Sugimoto et al. | 430/567 |
| 4,806,461 | 2/1989 | Ikeda et al. | 430/567 |
| 4,835,095 | 5/1989 | Ohashi et al. | 430/567 |
| 5,242,791 | 9/1993 | Hirano et al. | 430/569 |

FOREIGN PATENT DOCUMENTS

| | | | |
|---|---|---|---|
| 0147868 | 7/1985 | European Pat. Off. . | |
| 0282896 | 9/1988 | European Pat. Off. . | |
| 368275 | 5/1990 | European Pat. Off. | 430/567 |

*Primary Examiner*—Janet C. Baxter
*Attorney, Agent, or Firm*—Birch, Stewart, Kolasch & Birch

[57] ABSTRACT

An emulsion contains tabular silver halide having a thickness of less than 0.5 μm, a diameter of 0.3 μm or more, and a grain diameter/thickness ratio of 2 or more. The tabular silver halide grains account for at least 50% of a total projected area of all silver halide grains. 50% (number) or more of the tabular silver halide grains include 10 or more dislocations per grain. A relative standard elevation of silver iodide content of individual tabular silver halide 30% or less. This light-sensitive silver halide emulsion has a high sensitivity and a high gamma improved in photographic properties and in rate of development. Each tabular silver halide grain may internally have a portion where a silver iodide content is higher than that of the surface of the grain. When the light-sensitive silver halide emulsion is added to a silver halide emulsion layer, a photographic light-sensitive material having a high sensitivity and a high gamma and improved in photographic properties and in rate of development can be obtained.

19 Claims, No Drawings

SILVER HALIDE EMULSION AND PHOTOGRAPHIC LIGHT-SENSITIVE MATERIAL USING THE SAME

This is a continuation of application Ser. No. 08/137,808 filed on Oct. 19, 1993, now abandoned, which is a continuation application of Ser. No. 07/789,852 filed Nov. 8, 1991, now abandoned.

BACKGROUND OF THE INVENTION

1. Field of the Invention

The present invention relates to a silver halide photographic light-sensitive material and, more particularly, to a photographic light-sensitive material containing a tabular silver halide grain emulsion having improved photographic properties and an improved rate of development.

2. Description of the Related Art

Methods of manufacturing and using tabular silver halide grains are disclosed in, e.g., U.S. Pat. Nos. 4,434,226, 4,439,520, 4,414,310, 4,433,048, 4,414,306, and 4,459,353, JP-A-59-99433 ("JP-A" means unexamined published Japanese patent application), and JP-A-62-209445. The tabular grain is known for its various advantages such as an improvement in sensitivity including an improvement in color sensitizing efficiency obtained by a sensitizing dye, an improvement in a sensitivity/graininess relationship, an improvement in sharpness obtained by unique optical properties of the tabular grain, and an improvement in covering power.

JP-A-63-220238 discloses a technique of forming dislocations in grains in order to improve sensitivity, resistance to pressure, exposure illuminance dependency, and storage stability of tabular silver halide grains.

Recently, however, requirements for a photographic silver halide emulsion have become more strict, and a higher level demand has arisen for photographic properties such as sensitivity and in rate of development. Prior tabular silver halide grains cannot satisfy said demands.

SUMMARY OF THE INVENTION

It is an object of the present invention to provide a silver halide emulsion having a high sensitivity, a high gamma, an improved rate of development, and an excellent storage stability, and a photographic light-sensitive material using the emulsion.

The present inventors have made extensive studies and found that the object of the present invention can be achieved by a light-sensitive silver halide emulsion containing tabular silver halide grains having a thickness of less than 0.5 μm, a diameter of 0.3 μm or more, and a grain diameter/grain thickness ratio of 2 or more, wherein the tabular silver halide grains account for at least 50% of a total projected surface area of all silver halide grains, 50% (number) or more of the tabular silver halide grains include 10 or more dislocations per grain, and a relative standard deviation of silver iodide content of individual tabular silver halide grains is 30% or less.

In the light-sensitive silver halide emulsion, each of the tabular silver halide grains may internally have a portion where the silver iodide content is higher than that on the surface of the grain.

In addition, the present inventors have found that the object of the present invention can be achieved by a photographic light-sensitive material having at least one silver halide emulsion layer on a support, wherein said silver halide emulsion layer contains a light-sensitive silver halide emulsion containing tabular silver halide grains having a thickness of less than 0.5 μm, a diameter of 0.3 μm or more, and a grain diameter/grain thickness ratio of 2 or more, in which the tabular silver halide grains account for at least 50% of a total projected surface area of all silver halide grains, 50% (number) or more of the tabular silver halide grains include 10 or more dislocations per grain, and a relative standard deviation of silver iodide content of individual tabular silver halide grains is 30% or less.

In the light-sensitive silver halide emulsion, each of the tabular silver halide grains may internally have a portion where the silver iodide content is higher than that on the surface of the grain.

In the present invention, the tabular silver halide grain (to be referred to as a "tabular grain" hereinafter) means a grain which has two opposing parallel major faces and in which an equivalent-circle diameter of the major faces (i.e., a diameter of a circle having the same projected surface area as that of the major faces) is twice or more a distance between the major faces (i.e., the thickness of the grain).

An average grain diameter/grain thickness ratio of the emulsion having tabular grains according to the present invention is preferably 2 to 12, and most preferably, 2 to 8.

Although the average grain diameter/grain thickness ratio can be obtained by averaging grain diameter/grain thickness ratios of all tabular grains, it can be simply obtained as a ratio of an average diameter of all tabular grains to their average thickness.

The (equivalent-circle) diameter of the tabular grains of the present invention may be 0.2 to 5.0 μm, preferably, 0.3 to 4.0 μm, and more preferably, 0.3 to 3.0 μm. The grain thickness of the tabular grains of the present invention is 0.5 μm or less, preferably, 0.05 to 5.0 μm, and more preferably, 0.08 to 0.3 μm.

In the present invention, the grain diameter and the grain thickness can be measured from an electron micrograph of grains in accordance with a method described in U.S. Pat. No. 4,434,226. A silver halide of tabular grains is preferably silver iodobromide or silver chloroiodobromide. Especially a silver iodide content of the tabular grains is 0.1 to 20 mol %, preferably, 1 to 10 mol %. More preferably, the tabular grains contain 1 to 5 mol % of silver iodide bromide.

Dislocations in a tabular grain can be observed by a direct observation method using a transmission electron microscope at a low temperature as described in, e.g., J. F. Hamilton, Phot. Sci. Eng., 11, 57, (1967) or T. Shiozawa, J. Soc. Phot. Sci. Japan, 35, 213, (1972). That is, a silver halide grain extracted from an emulsion so as not to apply a pressure enough to form a dislocation in the grain is placed on a mesh for electron microscope observation, and observation is performed by a transmission method while the sample is cooled to prevent a damage (e.g., print out) caused by an electron beam. In this case, since it becomes difficult to transmit an electron beam as the thickness of a grain is increased, the grain can be observed more clearly by using a high-voltage (200 kV with respect to a grain having a thickness of 0.25 μm) electron microscope. By using photographs of grains obtained by this method, positions and the number of dislocations of each grain when the grain is viewed in a direction perpendicular to the major faces can be obtained.

Dislocations in the tabular grain of the present invention are formed in an area from x% of a length, from the center to the edge along the major axis of the tabular grain, to the edge. The value of x is preferably $10 \leqq x < 100$, more preferably, $30 \leqq x < 98$, and most preferably, $50 \leqq x < 95$. Although a shape obtained by connecting positions from which dislocations start is usually similar to the shape of the grain, it is sometimes not a perfect similar figure but distorted. In addition, dislocation lines are normally formed from substantially the center to the edge of the grain but are often zigzagged.

In the present invention, it is preferable that 50% (number) or more of tabular grains include 10 or more dislocations. More preferably, 80% (number) or more of grains include 10 or more dislocations, and most preferably, 80% (number) or more of grains include 20 or more dislocations.

In the tabular grains of the present invention, a relative standard deviation of silver iodide content of individual grains is 30% or less, and more preferably, 20% or less.

The silver iodide content of the individual emulsion grains included the emulsion can be measured by analyzing compositions of the grains using, e.g., an X-ray micro analyzer. The "relative standard deviation of silver iodide content of individual grains" means a value obtained by measuring silver iodide content of at least 100 emulsion grains by, e.g., the X-ray micro analyzer, dividing a standard deviation of the measured silver iodide content by an average silver iodide content, and multiplying the quotient by 100. A method of measuring silver iodide content of individual emulsion grains is described in, e.g., EP 147, 868A.

If the relative standard deviation of silver iodide content of individual grains is large, the individual grains have different optimal points in chemical sensitization to make it impossible to bring out performance of all the emulsion grains. In addition, á relative standard deviation of the numbers of dislocations between the grains tends to increase in this case.

Although correlation is not always present between a silver iodide content Yi [mol %] and an equivalent-sphere diameter Xi [micron] of each grain, it is preferably ably not present.

The structure of a halogen composition of the tabular grain can be confirmed by a combination of, e.g., x-ray diffraction, an EPMA (also called an XMA) method (in which silver halide grains are scanned by an electron beam to detect a silver halide composition), and an ESCA (also called an XPS) method (in which X rays are radiated to perform spectroscopy for photoelectrons emitted from the grain surface).

In the present invention, the grain surface means a region from the surface to a depth of about 50 Å. A halogen composition in such a region generally can be measured by the ESCA method. The interior of the grain means a region except for the surface region.

The tabular grains of the present invention are preferably monodisperse, in which a standard deviation in a grain size distribution of the grains is 25% or less. The relative standard deviation in this case is represented in terms of "a value obtained by multiplying, by 100, a value attained by dividing the variation (standard deviation) in grain sizes, which are calculated from the equivalent circle diameters of the projected areas of the individual tabular grains and their thicknesses, by an average grain size." The grains size (R μm) is obtained from the equivalent circle diameter (r μm) of a projected area and the thickness (d μm) in accordance with the following equation:

$$R=\sqrt[3]{\frac{3}{2}r^2d}$$

The grain size distribution of a silver halide emulsion consisting of silver halide grains, in which grain shapes are uniform and the variation in a grain size is small, almost exhibits a normal distribution, and consequently its standard deviation can be easily obtained. The relative standard deviation of the grain size distribution in the tabular grains of the present invention is, 25% or less, preferably 20% or less, and more preferably 15% or less.

A method of manufacturing the tabular grains will be described below.

The tabular grain manufacturing methods can be obtained by suitably combining methods known to those skilled in the art.

For example, tabular grains can be manufactured by forming seed crystals in which the tabular grains are present in an amount of 40% (weight) or more in a comparatively high-pAg atmosphere having a pBr of 1.3 or less and growing the seed crystals by adding silver and halide solutions while the pBr value is kept at the above value or more.

In the grain growth process in which silver and/or a halogen are/is added, silver and halogen solutions are preferably added so as not to form new crystal nuclei.

The size of the tabular grains can be adjusted by, for example, adjusting the temperature, selecting the type or amount of a solvent, or controlling the addition rates of silver salt and a halide used in the grain growth.

The emulsion of the present invention can be prepared on the basis of a method described in JP-A-63-220238. The silver halide emulsion of the present invention preferably has a narrow grain size distribution, and a method described in JP-A-63-151618 in which an emulsion is prepared via steps of nucleation-Ostwald ripening, and grain growth can be preferably used.

However, silver iodide content of individual grains in the emulsion tend to be nonuniform unless particularly precise control is performed.

In order to obtain a uniform silver iodide content between individual grains of the emulsion, it is important to make the size and the shape of grains as uniform as possible after the Ostwald ripening. In addition, in the growth step, an aqueous silver nitrate solution and an aqueous alkali halide solution are added by a double jet method while a pAg is maintained at constant within the range of 6.0 to 10.0. In order to perform particularly uniform coating, a degree of supersaturation of silver and halide in a solution containing the growing grain during addition is preferably high. For example, addition of the aqueous silver nitrate solution and the aqueous alkali halide solution is preferably performed at a comparatively high supersaturation degree at which the growth rate of crystals is 30% to 100% of a crystal critical growth rate in accordance with a method as described in U.S. Pat. No. 4,242,445.

Dislocations in the tabular grain of the present invention can be controlled by forming a specific iodide rich phase inside the grain. More specifically, substrate grains are prepared, and an iodide rich phase is formed on each grain and covered with a region having an iodide content lower than that in the iodide rich phase. In order to obtain a uniform silver iodide content between the individual grains, it is important to properly select formation conditions of the iodide rich phase.

The internal iodide rich phase means a silver halide solid solution containing iodide. This silver halide is preferably silver iodide, silver iodobromide, or silver chloroiodobromide, more preferably, silver iodide or silver iodobromide (iodide content=10 to 40 mol %), and most preferably, silver iodide.

It is important not to uniformly deposit this internal iodide rich phase on the plane surface of a substrate tabular grain but to localize it. This localization may be caused on any of the major plane face, the side face, the edge, and the corner of the tabular grain. Alternatively, the internal iodide rich phase may be selectively, epitaxially coordinated in these portions.

For this purpose, a so-called conversion method in which iodide salt is singly added, or an epitaxial junction method as described in JP-A-59-133540, JP-A-58-108526, or JP-A-59-162540 can be used. In these methods, it is effective to select the following conditions in order to obtain a uniform silver iodide content between individual grains. That is, the pAg of an iodide salt additive is preferably 8.5 to 10.5, and most preferably, 9.0 to 10.5, and the temperature is preferably held at 50° C. to 30° C. The iodide salt is preferably added under sufficient stirring in an amount of 1 mol % with respect to a total silver amount over 30 seconds to five minutes.

The iodide content of a substrate tabular grain is lower than the iodide rich phase, preferably, 0 to 12 mol %, and more preferably, 0 to 10 mol %.

The tabular silver halide grain disclosed in the present invention, forms a latent image mainly in the interior of the grains, is a so-called negative silver halide grain. It is assumed that unlike an autopositive or direct positive silver halide grain forming a direct positive image, the negative silver halide grain is subjected to a series of processing steps including a development step, such as color reversal processing, which yields a negative image.

The tabular silver halide grain of the present invention, forms a latent image mainly in the interior of the grain and, is preferably subjected to a processing step using a developer which contains a silver halide solvent.

In the present invention, the "negative silver halide grain forming a latent image mainly in the interior of the grains" is defined as follows.

That is, a silver halide emulsion is coated on a triacetate support so that a coating silver amount is 2.0 g/m$^2$, and the resulting sample is wedge-exposed with light of 4,800° K. at appropriate illuminance for 1/100 sec. The exposed sample is developed with the following developer A (surface developer) at 25° C. for five minutes. If the resultant sensitivity (normally represented in terms of the reciprocal of an exposure amount which yields a density of fog plus 0.2) is lower than at least one of sensitivities obtained when the sample is developed with the following developers B to E (internal developers) at 25° C. for five minutes, this silver halide emulsion is defined as the negative silver halide grain forming a latent image mainly in the interior of the grains, i.e, the internal latent image type silver halide grain of the present invention.

| | Developers A – E (each with pH = 9.6) | | | | |
|---|---|---|---|---|---|
| Compund | A | B | C | D | E |
| N-methyl- | 2.5 g | 2.5 g | 2.5 g | 2.5 g | 2.5 g |

-continued

| | Developers A – E (each with pH = 9.6) | | | | |
|---|---|---|---|---|---|
| Compund | A | B | C | D | E |
| p-amino-phenol sulfate | | | | | |
| Sodium ascorbate | 10.0 g | 10.0 g | 10.0 g | 10.0 g | 10.0 g |
| Potassium metaborate | 35.0 g | 35.0 g | 35.0 g | 35.0 g | 35.0 g |
| Potassium bromide | 1.0 | 1.0 | 1.0 | 1.0 | 1.0 |
| Sodium thiosulfate | — | 1.0 g | 2.0 g | 5.0 g | 10.0 g |
| Water to make | 1.0 l | 1.0 l | 1.0 l | 1.0 l | 1.0 l |

The tabular silver halide grain of the present invention, forming a latent image mainly in the interior of the grains has a core and a shell. The core is obtained by performing, in accordance with a conventional method, chemical sensitization of an arbitrary combination of sulfur sensitization, gold sensitization, and reduction sensitization for a tabular silver halide grain prepared by a conventional method. The shell partially or entirely covers the surface of the core. A ratio accounted for by a silver amount of the shell with respect to a silver amount of the entire grain is preferably 50% or less, and more preferably 1% to 30% with respect to an average value of all the tabular silver halide grains contained in the emulsion, each of which forms a latent image mainly in the interior of the grain. This ratio can be optimized in accordance with conditions such as the layer arrangement of a light-sensitive material, processing solutions, processing times, and processing methods.

Formation of the shell is commonly performed by addition of an aqueous silver salt solution and an aqueous halogen solution, such as single jet or double jet. In addition, a method of adding an emulsion containing a fine grain silver halide and performing Ostwald ripening can be used preferably.

The iodide content of the outer phase which covers the iodide rich phase is lower than that of the iodide rich phase, preferably, 0 to 12 mol %, more preferably, 0 to 10 mol %, and most preferably, 0 to 3 mol %.

This internal iodide rich phase is present in an annular region about the center of a tabular grain, which falls within the range of preferably 5 to 80 mol % (silver amount), more preferably, 10 to 70 mol %, and most preferably, 20 to 60 mol % of the whole grain with respect to the major axis direction of the grain.

The major axis direction of a grain means the direction of diameter of a tabular grain, and the minor axis direction means the direction of thickness of the grain.

The iodide content of the internal iodide rich phase is preferably five times, and most preferably, 20 times the average iodide content of silver iodide, silver iodobromide, or silver chloroiodobromide present on the surface of a grain.

An amount of a silver halide for forming the internal iodide rich phase is preferably 50 mol % or less (silver amount), more preferably, 10 mol % or less, and most preferably, 5 mol % or less of a silver amount of the whole grain.

In the manufacture of tabular grains of the present invention, it is preferred to use methods of increasing the addition rates, the addition amounts, and the addition concentrations of a silver salt solution (e.g., an aqueous $AgNO_3$ solution) and a halide solution (e.g., an aqueous KBr solution) to be added in order to accelerate grain growth.

Examples of the methods are described in British Patent 1,335,925, U.S. Pat. Nos. 3,672,900, 3,650,757, and 4,242,445, JP-A-55-142329, and JP-A-55-158124.

A silver halide solvent is useful to promote ripening. For example, it is known that an excessive amount of halogen ions are supplied in a reactor vessel to promote ripening. Therefore, it is apparent that ripening can be promoted by only supplying a silver halide solution in a reactor vessel and that another ripening agent can be used. A total amount of these ripening agents can be mixed in a dispersion medium in a reactor vessel before silver salt and a halide are supplied in the vessel, or they can be supplied in the reactor vessel together with one or more halide salts, silver salt, or a deflocculant. As an another altered embodiment, the ripening agents can be independently supplied in the step of adding halide salts and silver salt.

Examples of the ripening agent except for the halogen ion are ammonia, an amine compound, and a thiocyanate (e.g., an alkali metal thiocyanate, particularly, sodium or potassium thiocyanate, and ammonium thiocyanate). The use of a thiocyanate ripening agent is described in U.S. Pat. Nos. 2,222,264, 2,448,534, and 3,320,069. In addition, conventional thioether ripening agents as described in U.S. Pat. Nos. 3,271,157, 3,574,628, and 3,737,313 can be used. Also, thion compounds as disclosed in JP-A-53-82408 and JP-A-53-144319 can be used.

The properties of silver halide grains can be controlled by using various types of compounds in a process of silver halide precipitation formation. Such a compound can be present in a reactor vessel beforehand or added together with one or more salts in accordance with a conventional method. As described in U.S. Pat. Nos. 2,448,060, 2,628,167, 3,737,313, and 3,772,031 and Research Disclosure, Vol. 134, No. 13452, June, 1975, the characteristics of the silver halide can be controlled by having compounds of copper, iridium, lead bismuth, cadmium, zinc (e.g., calcogen compounds of sulfur, selenium, and tellurium), gold, and a Group VII noble metal in the silver halide precipitation formation process. As described in JP-B-58-1410 ("JP-B" means examined published Japanese patent application) and Moisar et al., "Journal of Photographic Science", Vol. 25, 1977, pp. 19 to 27, the interior of each grain of the silver halide emulsion can be subjected to reduction sensitization during the precipitation formation process.

The tabular grain used in the present invention may be bonded to a silver halide having a different composition by an epitaxial junction, or to a compound except for a silver halide such as silver rhodanate or zinc oxide. These emulsion grains are disclosed in, e.g., U.S. Pat. Nos. 4,094,684, 4,142,900, and 4,459,353, British Patent 2,038,792, U.S. Pat. Nos. 4,349,622, 4,395,478, 4,433,501, 4,463,087, 3,656,962, and 3,852,067, and JP-A-59-162540.

The tabular grain of the present invention is normally, chemically sensitized.

Chemical sensitization can be performed by using active gelatin as described in T. H. James, "The Theory of the Photographic Process", 4th ed., Macmillan, 1977, PP. 67 to 76. Alternatively, chemical sensitization can be performed at a pAg of 5 to 10, a pH of 5 to 8, and a temperature of 30° C. to 80° C. by using sulfur, selenium, tellurium, gold, platinum, palladium, iridium, or a combination of a plurality of these sensitizers as described in Research Disclosure Vol. 120, No. 12008 (April, 1974), Research Disclosure Vol. 34, No. 13452 (June, 1975), U.S. Pat. Nos. 2,642,361, 3,297,446, 3,772,031, 3,857,711, 3,901,714, 4,266,018, and 3,904,415, and British Patent 1,315,755. Chemical sensitization is optimally performed in the presence of a gold compound and a thiocyanate compound, or compounds described in U.S. Pat. Nos. 3,857,771, 4,266,018, and 4,054,457 (e.g. a sulfur-containing compound) or a sulfur-containing compound of a hypo, a thiourea type compound, or a rhodanine type compound.

Chemical sensitization can also be performed in the presence of a chemical sensitization assistant. Examples of the chemical sensitization assistant are compounds known to suppress fog and increase sensitivity in the chemical sensitization process such as azaindene, azapyridazine, and azapyrimidine. Examples of a chemical sensitization assistant modifier are described in U.S. Pat. Nos. 2,131,038, 3,411,914, and 3,554,757, JP-A-58-126526, and G. F. Duffin, "Photographic Emulsion Chemistry", PP. 138 to 143. In addition to or in place of chemical sensitization, reduction sensitization can be performed by using, e.g., hydrogen as described in U.S. Pat. Nos. 3,891,446 and 3,984,249. Reduction sensitization can also be performed by using a reducing agent such as stannous chloride, thiourea dioxide, or polyamine or by performing a low pAg (e.g., less than 5) treatment and/or a high pH (e.g., larger than 8) treatment as described in U.S. Pat. Nos. 2,518,698, 2,743,182, and 2,743,183. Alternatively, a color sensitizing property can be improved by chemical sensitization methods described in U.S. Pat. Nos. 3,917,485 and 3,966,476.

A sensitization method using an oxidizing agent described in JP-A-61-3134 or JP-A-61-3136 can be applied to the chemical sensitization of the present invention.

The emulsion consisting of the tabular grains of the present invention can be used, in a single silver halide emulsion layer, together with an emulsion consisting of silver halide grains (to be referred to as non-tabular grains hereinafter) subjected to conventional chemical sensitization. Especially in a color photographic light-sensitive material, the tabular grain emulsion and the non-tabular grain emulsion can be used in different emulsion layers and/or a single emulsion layer. Examples of the non-tabular grain are regular grains having regular crystal shapes such as a cubic shape, an octahedral shape, and a tetradecahedral shape, and grains having irregular shapes such as a spherical crystal shape and a potato-like shape. A silver halide of such a non-tabular grain may be any of silver bromide, silver iodobromide, silver iodochlorobromide, silver chlorobromide, and silver chloride. The silver halide is preferably silver iodobromide or silver iodochlorobromide containing 30 mol % or less of silver iodide, and most preferably, silver iodobromide containing 2 to 25 mol % of silver iodide.

The non-tabular grains used in the present invention may be fine grains having a grain size of 0.1 μm or less or large grains having a projected surface area diameter of 10 μm. The emulsion may be a monodisperse emulsion having a narrow distribution of a grain size or a polydisperse emulsion having a wide distribution.

The non-tabular grains used in the present invention can be prepared by methods described in, for example, P. Glafkides, "Chimie et Physique Photographique", Paul Montel, 1967; G. F. Duffin, "Photographic Emulsion Chemistry", Focal Press, 1966; and V. L. Zelikman et al., "Making and Coating Photographic Emulsion", Focal Press, 1964.

That is, the non-tabular grains can be prepared by, e.g., any of an acid method, a neutralization method, and an ammonia method. As a system for reacting a soluble silver salt and a soluble halide, a single jet method, a double jet method, and a combination thereof can be used. Also, a so-called back mixing method for forming silver halide grains in the presence of excessive silver ions can be used. As one system of the double jet method, a so-called controlled double jet method wherein a pAg in a liquid phase generated in a silver halide is maintained constant can be used. According to this method, a silver halide emulsion having a regular crystal shape and almost uniform grain sizes can be obtained.

Two or more types of separately formed silver halide emulsions may be mixed.

A silver halide emulsion containing the above-mentioned regular grains can be obtained by controlling a pAg and a pH during grain formation. More specifically, such a method is described in, e.g., "Photographic Science and Engineering", Vol. 6, pp. 159 to 165 (1962), "Journal of Photographic Science", Vol. 12, pp. 242 to 251 (1964), U.S. Pat. No. 3,655,394, and British Patent 1,413,748.

A monodisperse emulsion is described in, e.g., JP-A-48-8600, JP-A-51-39027, JP-A-51-83097, JP-A-53-137133, JP-A-54-48521, JP-A-54-99419, JP-A-58-37635, JP-A-58-49938, JP-B-47-11386, U.S. Pat. No. 3,655,394, and British Patent 1,413,748.

These non-tabular grains may have a uniform crystal structure, may have different silver halide in the interior and the surface layer of the grain, or may have a layered structure. These emulsion grains are disclosed in, e.g., British Patent 1,027,146, U.S. Pat. Nos. 3,505,068 and 4,444,877, and JP-A-60-143331.

In the present invention, in order to, for example, accelerate development, improve storage stability, or effectively use reflected light, a non-light-sensitive fine grain emulsion having a grain size of 0.6 μm or less, and preferably, 0.2 μm or less may be added to a silver halide emulsion layer, an interlayer, or a protective layer.

The tabular grains of the present invention are preferably used in a color photographic light-sensitive material.

When the silver halide emulsion (to be referred to as a tabular grain emulsion hereinafter) of the present invention is used together with, particularly, a non-tabular monodisperse silver halide grain emulsion in a single emulsion layer and/or different emulsion layers, sharpness and graininess can be sometimes simultaneously improved.

The monodisperse silver halide emulsion (non-tabular grain) is defined as an emulsion in which grain sizes of grains accounting for 95% (weight or number) or more of all silver halide grains fall within the range of q40%, and more preferably, q30% of an average grain size. The fact that the graininess can be improved by using the monodisperse silver halide emulsion in a silver halide photographic light-sensitive material is described in, e.g., JP-B-47-11386, JP-A-55-142329, JP-A-57-17235, or JP-A-59-72440. In addition, as described in T. H. James, "The Theory of Photographic Process", PP. 580 to 585, it is known that monodisperse silver halide grains having an average grain size of 0.3 to 0.8 μm has a large degree of light scattering with respect to light having a particular wavelength but has a comparatively small light scattering degree with respect to light having another wavelength.

Therefore, when the tabular silver halide grain having a grain diameter/grain thickness ratio of 2 or more and the monodisperse silver halide emulsion are properly arranged in consideration of the optical characteristics and the graininess of each silver halide emulsion, the sharpness and the graininess of the silver halide photographic light-sensitive material can be sometimes simultaneously improved.

Some examples of the arrangements as described above will be enumerated below.

(Arrangement 1) In a light-sensitive material in which red-, green-, and blue-sensitive layers are arranged from a support in an order named, if an average grain size of silver halide grains contained in a silver halide emulsion layer constituting the blue-sensitive layer falls within the range of 0.3 to 0.8 μm, a tabular grain emulsion is used in this emulsion layer. If the average grain size does not fall within the above range, a monodisperse silver halide emulsion is used. As a result, the sharpness of each of the green- and red-sensitive layers can be improved, and the graininess of the blue-sensitive layer can be improved.

(Arrangement 2) In a light-sensitive material having the same layer arrangement as in Arrangement 1, if an average grain size of silver halide grains contained in a silver halide emulsion layer constituting the green-sensitive layer falls within the range of 0.4 to 0.8 μm, a tabular grain emulsion is used in this emulsion layer. If the average grain size does not fall within the above range, a monodisperse emulsion is used. As a result, the graininess of the green-sensitive layer can be improved while the sharpness of the red-sensitive layer is improved.

(Arrangement 3) In a light-sensitive material having the same layer arrangement as in Arrangement 1 in which an emulsion layer sensitive to a same color is constituted by two or more layers having different sensitivities, if a monodisperse silver halide emulsion (particularly, double structure grains are preferable) having a grain size of 1.0 μm or more is used in a blue-sensitive layer having the highest sensitivity and a degree of light scattering in a blue-sensitive layer having a lower sensitivity is large, a tabular grain emulsion is used in this low-sensitivity blue-sensitive layer. As a result, the sharpness of each of the green- and red-sensitive layers can be improved.

(Arrangement 4) In a light-sensitive material having the same layer arrangement as in Arrangement 3, if a degree of light scattering is large in all of a plurality of green-sensitive layers, a tabular grain emulsion is used in all of these green-sensitive layers. As a result, the graininess of the green-sensitive layer can be improved while the sharpness of the red-sensitive layer is improved.

As in Arrangements 3 and 4, when each of blue-, green-, and red-sensitive layers is constituted by a plurality of emulsion layers, in order to improve the sharpness and the graininess, a tabular grain emulsion must be used in emulsion layers having a large light scattering degree, and a monodisperse emulsion must be used in emulsion layers having a small light scattering degree. If a tabular grain emulsion is also used in the red-sensitive layer in Arrangement 4, in addition to the green-sensitive layers a degree of light scattering between emulsion layers may be increased to degrade the sharpness of the green-sensitive layer formed on the red-sensitive layer. In the other case, the use of a tabular grain emulsion in a red-sensitive layer closest to a support may be not preferred sometimes.

As described above, the tabular grain emulsion and the monodisperse silver halide emulsion used in the present invention are normally subjected to physical ripening, chemical ripening, and spectral sensitization. Additives for use in these steps are described in Research Disclosure Nos. 17643 and 18716, and they are summarized in Table 1 below.

Known photographic additives usable in the present invention are also described in the above two Research Disclosures and summarized in Table 1 below.

TABLE 1

| Additives | RD No. 17643 | RD No. 18716 |
|---|---|---|
| 1. Chemical sensitizers | page 23 | page 648, right column |
| 2. Sensitivity increasing agents | | page 648, right column |
| 3. Spectral sensitizers, super sensitizers | pages 23–24 | page 648, right column to page 649, right column |
| 4. Brighteners | page 24 | |
| 5. Antifoggants and stabilizers | pages 24–25 | page 649, right column |
| 6. Light absorbents, filter dyes, ultraviolet absorbents | pages 25–26 | page 649, right column to page 650, left column |
| 7. Stain preventing agents | page 25, right column | page 650, left to right columns |
| 8. Dye image stabilizers | page 25 | |
| 9. Film hardening agents | page 26 | page 651, left column |
| 10. Binder | page 26 | page 651, left column |
| 11. Plasticizers, lubricants | page 27 | page 650, right column |
| 12. Coating aids, surfactants | pages 26–27 | page 650, right column |
| 13. Antistatic agents | page 27 | page 650, right column |

Various color couplers can be used in the photographic light-sensitive material of the present invention. Examples of these couplers are disclosed in patents described in above-mentioned Research Disclosure (RD) NO. 17643, VII-C to VII-G. AS dye forming couplers, couplers for forming three primary colors (i.e., yellow, magenta, and cyan) of subtractive color processes by color development are important. Examples of a 4- or 2-equivalent coupler are those disclosed in the patents described in the RD No. 17643, VII-C and VII-D. In addition, the following couplers can be preferably used in the present invention.

A representative example of a yellow coupler usable in the photographic light-sensitive material of the present invention is a hydrophobic acylacetoamide coupler having a ballast group. Examples of this coupler are described in, e.g., U.S. Pat. Nos. 2,407,210, 2,875,057, and 3,265,506. The use of a 2-equivalent yellow coupler is preferred in the present invention. Representative examples of this coupler are oxygen atom elimination yellow couplers descried in, e.g., U.S. Pat. Nos. 3,408,194, 3,447,928, 3,933,501, and 4,022,620, and yellow couplers having leaving groups connected through a nitrogen atom described in, e.g., JP-B-58-10739, U.S. Pat. Nos. 4,401,752 and 4,326,024, RD No. 18035 (April, 1979), British Patent 1,425,020, Published Unexamined west German Patent Application Nos. 2,219,917, 2,261, 361, 2,329,587, and 2,433,812. An α-pivaloylacetoanilide type coupler is excellent in fastness, particularly, light fastness of a colored dye whereas an α-Penzoylacetoanilide type coupler provides a high coloring density.

Examples of a magenta coupler usable in the photographic light-sensitive material of the present invention are hydrophobic indazolone type and cyanoacetyl type, preferably, 5-pyrazolone type and pyrazoloazole type couplers having a ballast group. The 3-position of the 5-pyrazolone type coupler is preferably substituted by an arylamino group or an acylamino group in terms of a color phase or a coloring density of a colored dye.

Representative examples of this coupler are described in, e.g., U.S. Pat. Nos. 2,311,082, 2,343,703, 2,600,788, 2,908, 573, 3,062,653, 3,152,896, and 3,936,015. The most preferable example of a leaving group of the 2-equivalent 5-pyrazolone type coupler is a leaving group connected through a nitrogen atom described in U.S. Pat. No. 4,310, 619 or an arylthio group described in U.S. Pat. No. 4,351, 897. A 5-pyrazolone type coupler having a ballast group described in EP 73,636 can provide a high coloring density. Examples of the pyrazoloazole type coupler are pyrazolobenzimidazoles described in U.S. Pat. No. 3,061,432, and preferably, pyrazolone[5,1-c][1,2,4]triazoles described in U.S. Pat. No. 3,725,067, pyrazolotetrazoles described in Research Disclosure No. 24220 (June, 1984) and JP-A-60-33552, and pyrazolopyrazoles described in Research Disclosure No. 24230 (June, 1984) and JP-A-60-43659. Since an amount of yellow secondary absorption of a colored dye is small and light fastness is high, imidazo[1,2-b]pyrazoles described in U.S. Pat. No. 4,500,630 are preferable and pyrazolo[1,5-b][1,2,4]triazoles described in U.S. Pat. No. 4,540,654 are most preferable.

Examples of a cyan coupler usable in the photographic light-sensitive material of the present invention are hydrophobic and nondiffusing naphthol and phenol type couplers. Representative examples of the naphthol type coupler are a naphthol type coupler described in U.S. Pat. No. 2,474,293, and preferably, 2-equivalent naphthol type couplers having leaving groups connected through an oxygen atom described in U.S. Pat. Nos. 4,052,212, 4,146,396, 4,228,233, and 4,296,200. Examples of the phenol type coupler are described in, e.g., U.S. Pat. Nos. 2,369,929, 2,801,171, 2,772,162, and 2,895,826.

A coupler capable of forming a cyan dye fast to a humidity and a temperature can be preferably used in the present invention. Typical examples of this coupler are a phenol type cyan coupler having an alkyl group which number of carbon atoms is two on more in a meta position of a phenol nucleus described in, e.g., U.S. Pat. No. 3,772, 002, 2,5-diacylamino-substituted phenol type couplers described in, e.g., U.S. Pat. Nos. 2,772,162, 3,758,308, 4,126,396, 4,334,011, and 4,327,173, Published Unexamined West German Patent Application No. 3,329,729, and EP 121,365, and phenol type couplers having a phenylureido group in a 2-position and an acylamino group in a 5-position described in, e.g., U.S. Pat. Nos. 3,446,622, 4,333,999, 4,451,559, and 4,427,767. A cyan coupler described in EP 161,626A in which the 5-position of naphthol is substituted by e.g. a sulfonamide group or an amide group can also be preferably used in the present invention because it has a high fastness of a colored image.

In order to correct unnecessary absorption of a colored dye, a photographic light-sensitive material is preferably subjected to masking using a colored coupler. Typical examples are yellow-colored magenta couplers described in, e.g., U.S. Pat. No. 4,163,670 and JP-B-57-39413, and magenta-colored cyan couplers described in, e.g., U.S. Pat. Nos. 4,004,929 and 4,138,258, and British Patent 1,146,368. Other colored couplers are described in RD 17643, VII-G described above.

The graininess can be improved by using a coupler capable of forming a colored dye having proper diffusibility. Examples of this coupler are magenta couplers described in U.S. Pat. No. 4,366,237 and British Patent 2,125,570, and yellow, magenta, and cyan couplers described in EP 96,570 and Published Unexamined West German Patent Application No. 3,234,533.

Dye forming couplers and the above special couplers may form a polymer of a dimer or more. Typical examples of the polymerized dye forming coupler are described in U.S. Pat. Nos. 3,451,820 and 4,080,211. Examples of a polymerized magenta coupler are described in British Patent 2,102,173 and U.S. Pat. No. 4,367,282.

A coupler which releases a photographically useful residue upon coupling can also be preferably used in the present invention. Useful examples of a DIR coupler for releasing a development inhibitor are those disclosed in the patents described in RD No. 17643, VII-F.

Preferable examples of a coupler usable in combination with the silver halide grains of the present invention are a developing agent deactivation type coupler described in JP-A-57-151944; timing type couplers described in U.S. Pat. No. 4,248,962 and JP-A-57-154234; and a reactive type coupler described in JP-A-60-184248. The most preferable examples of the coupler are developing agent deactivation type DIR couplers described in, e.g., JP-A-57-151944, JP-A-58-217932, JP-A-60-218645, JP-A-60-225156, JP-A-59-82214, and JP-A-60-233650, and a reactive type DIS coupler described in, e.g., JP-A-60-184248.

In the photographic light-sensitive material of the present invention, a coupler which imagewise releases a nucleating agent, a development accelerator, or a precursor thereof upon development can be used. Examples of this coupler are described in British Patents 2,097,140 and 2,131,188. A coupler which releases e.g. a nucleating agent having an adsorbing effect with respect to a silver halide is most preferred. Examples of this coupler are described in, e.g., JP-A-59-157638 and JP-A-59-170840.

The couplers for use in this invention can be added to the light-sensitive material by various known dispersion methods.

Examples of a high-boiling organic solvent used in an oil spot-in-water dispersion method are described in, e.g., U.S. Pat. No. 2,322,027.

Steps, effects, and examples of a latex for impregnation of a latex dispersion method are described in, e.g., U.S. Pat. No. 4,199,363 and West German Patent Application (OLS) Nos. 2,541,274 and 2,541,230.

Examples of a suitable support which can be used in the present invention are described in, e.g., RD No. 17643, page 28 and RD No. 187116, page 647, right column to page 648, left column.

The color photographic light-sensitive material according to the present invention can be developed by conventional methods described in RD No. 17643, PP. 28 and 29 and RD No. 18716, page 651, left to right columns.

The color photographic light-sensitive material of the present invention can be normally washed or stabilized after it is developed and bleach-fixed or fixed.

The step of washing is generally performed by arranging two or more tanks in a counter flow manner to save water. A representative example of stabilization instead of washing is multi-stage counter flow stabilization described in JP-A-57-8543. This step of stabilization requires two to nine counter flow baths. Various types of compounds are added to the stabilizing baths in order to stabilize images. Representative examples are various types of buffering agents (e.g., combinations of borate, metaborate, borax, phosphate, carbonate, potassium hydroxide, sodium hydroxide, ammonia water, monocarboxylic acid, dicarboxylic acid, and polycarboxylic acid) for adjusting a film pH (e.g., a pH of 3 to 8). In addition, various types of additives such as a water softener (e.g., inorganic phosphoric acid, aminopolycarboxylic acid, organic phosphoric acid, aminopolyphosphonic acid, and phosphonocarboxylic acid), a germicide (e.g., benzoisothiazolinone, isothiazolone, 4-thiazolinebenzimidazole, and phenol halide), a surfactant, a fluorescent brightener, a film hardener can be used as needed. Two or more types of compounds having the same effect or different effects can be simultaneously used.

Preferable examples of a film pH adjusting agent used after the treatments are various ammonium salts such as ammonium chloride, ammonium nitrate, ammonium sulfate, ammonium phosphate, ammonium sulfite, ammonium thiosulfate.

The present invention can be applied to various types of color light-sensitive materials. Representative examples of the material are a color negative film for general purposes or movies, a color reversal film for slides or television, color paper, a color positive film, and color reversal paper. The present invention can also be applied to a black and white light-sensitive material using mixing of three color couplers described in, e.g., Research Disclosure No. 17123 (July, 1978).

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

EXAMPLE 1

(1) Preparation of Emulsion

An aqueous solution was obtained by dissolving 6 g of potassium bromide and 30 g of inert gelatin into 3.7 l of distilled water, and a 14% aqueous potassium bromide solution and a 20% aqueous silver nitrate solution were added to the above aqueous solution under stirring by a double jet method at predetermined flow rates, a temperature of 55° C., and a pAg of 9.6 over one minute (in this addition (I), 2.40% of a total silver amount were consumed). Subsequently, after an aqueous gelatin solution (17%, 3,300 cc) was added and the resultant solution was stirred at 55° C., a 20% aqueous silver nitrate solution was added at a predetermined flow rate until the pAg reached 8.40 (in this addition (II), 5.0% of the total silver amount were consumed). 35 μl of a 25% aqueous $NH_3$ solution was added to the resultant solution of which temperature was increased to 75° C., and the resultant solution was held in this state for 15 minutes. Thereafter, 510 μl of $1NH_2SO_4$ were added to neutralize the solution. A 20% potassium bromide solution containing potassium iodide so as to add 8.3 g of potassium iodide and a 33% aqueous silver nitrate solution were added by the double jet method over 80 minutes (in this addition (III), 92.6% of the total silver amount were consumed). During the addition, the temperature and the pAg were held at 75° C. and 8.10, respectively. A silver nitrate amount used in this emulsion was 425 g. The resultant emulsion was desalted by a conventional flocculation method and subjected to optimal gold-plus-sulfur sensitization in the presence of sensitizing dyes S-5 and S-6 shown in Table 4, thereby preparing a tabular AgBrI (AgI=2.0 mol %) emulsion 1 as a comparative example.

An emulsion 2 as a comparative example was prepared following the same procedures as for the emulsion 1 except that potassium iodide was removed from the halogen solution used in the addition (III), 830 ml of a 1% aqueous potassium bromide solution were added over about ten seconds by temporarily stopping addition of the silver nitrate and potassium bromide solutions when 40% of the total silver amount were consumed during the addition (III), and the flow rate of the remaining addition (III) was tripled.

An emulsion 3 as a comparative example was prepared following the same procedures as for the emulsion 2 except that addition of the aqueous potassium iodide solution was performed over 90 seconds.

An emulsion 4 of the present invention was prepared following the same procedures as for the emulsion 3 except that an aqueous potassium bromide solution were added to adjust the pAg to be 9.0 immediately before addition of the aqueous potassium iodide solution.

An emulsion 5 of the present invention was prepared following the same procedures as for the emulsion 3 except that the temperature was set at 50° C. immediately before addition of the aqueous potassium iodide solution. Addition of the potassium bromide and silver nitrate aqueous solution by the double jet method after addition of the aqueous potassium iodide solution was performed at a temperature of 30° C. and a pAg of 8.1.

An emulsion 6 of the present invention was prepared following the same procedures as for the emulsion 3 except that the temperature was set at 30° C. immediately before addition of the aqueous potassium iodide solution. Addition of potassium bromide and silver nitrate aqueous solution by the double jet method after addition of the aqueous silver nitrate solution was performed at a temperature of 30° C. and a pAg of 8.1.

An emulsion 7 of the present invention was prepared following the same procedures as for the emulsion 5 except that an aqueous potassium bromide solution was added to adjust the temperature and the pAg to be 50° C. and 9.4, respectively, immediately before addition of the aqueous potassium iodide solution.

The equivalent-sphere diameters of the emulsions 1 to 7 prepared as described above were equally 1.0 μm, and their average grain diameter/grain thickness ratios fell within the range of 6.5 to 7.0.

The emulsions 1 to 7 were subjected to direct observation of dislocations by using a transmission electron microscope in accordance with a method described in Example I-(2) of JP-A-63-220238. As a result, no dislocation was observed in the emulsion 1, and ten or more dislocation lines were observed in 50% (number) or more of grains in each of the emulsions 2 to 7. As compared with the emulsions 2 and 3, dislocation lines were observed uniformly between grains in each of the emulsions 4 to 7.

An intergranular iodide distribution of each of the emulsions 1 to 7 was checked in accordance with a method described in EP 147,868A. The result is shown in Table 2.

TABLE 2

| Emulsion | 1 | 2 | 3 | 4 | 5 | 6 | 7 |
|---|---|---|---|---|---|---|---|
| Intergranular iodide distribution (%) | 20 | 85 | 65 | 30 | 25 | 15 | 12 |

(2) Formation and Evaluation of Coating Samples

Dodecylbenzenesulfonate as a coating aid, p-vinylbenzenesulfonate as a thickening agent, a vinylsulfone compound as a film hardener, and a polyethyleneoxide compound as a photographic property modifier were added to each of the emulsions prepared in item (1) above, thereby preparing emulsion coating solutions. Subsequently, each coating solution was uniformly coated on a undercoated polyester base, and a surface protective layer mainly consisting of an aqueous gelatin solution was coated thereon, thereby forming coating samples 1 to 3 respectively having the emulsions 1 to 3 as comparative examples, and coating samples 4 to 7 respectively having the emulsions 4 to 7 of the present invention. In each of the samples 1 to 7, a coating silver amount was 4.0 g/m$^2$, a gelatin coating amount of the protective layer was 1.3 g/m$^2$, and a gelatin coating amount of the emulsion layer was 2.7 g/m$^2$.

The following experiment was conducted to evaluate the coating samples formed as described above.

A sample piece of each of the coating samples 1 to 7 was wedge-exposed at an exposure amount of 10 CMS for an exposure time of 1/100 sec and developed by a processing solution having the following composition at 20° C. for four minutes. Subsequently, the resultant sample piece was subjected to fixing, washing and drying, and sensitometry was performed to obtain sensitivity by a reciprocal of an exposure amount at which a density of fog +0.1 was obtained. A gamma was obtained from an inclination of a line connecting points D=0.2 and D=1.0 on a characteristic curve. Subsequently, a pair of sample pieces of each of the coating samples 1 to 7 were wedge-exposed following the same exposure conditions as described above and developed by the same processing solution at 20° C. for two minutes, and at 20° C. for eight minutes, respectively. After the two sample pieces were subjected to fixing, washing, and drying, sensitometry was performed to obtain sensitivity of each sample piece at the two development by a reciprocal of an exposure amount at which a density of fog +0.1 was obtained, and a rate of development was evaluated from a relative value of the sensitivity corresponding to the development time of two minutes with respect to that of eight minutes.

| Processing solution | |
|---|---|
| 1-phenyl-3-pyrazolidone | 0.5 g |
| Hydroquinone | 10 g |
| Disodium ethylenediamine tetraacetate | 2 g |
| Potassium sulfite | 60 g |
| Boric acid | 4 g |
| Potassium carbonate | 20 g |
| Sodium bromide | 5 g |
| Diethyleneglycol | 20 g |
| Sodium hydroxide was added to adjust pH to be 10.0 | |
| Water to make | 1 l |

The obtained results are summarized in Table 3.

TABLE 3

| Coating Sample No. | Emulsion No. | Area (%) | Dislocations | Intergranular iodide distribution (%) | Photographic properties Relative Sensitivity *) | Gamma | Rate of development **) | |
|---|---|---|---|---|---|---|---|---|
| 1 | 1 | | None | 20 | 100 | 0.80 | 50 | Comparative Example |
| 2 | 2 | | Present | 85 | 120 | 1.12 | 54 | Comparative Example |
| 3 | 3 | | " | 65 | 122 | 1.12 | 54 | Comparative Example |
| 4 | 4 | | " | 30 | 130 | 1.20 | 65 | Present Invention |
| 5 | 5 | | " | 25 | 133 | 1.20 | 67 | Present Invention |
| 6 | 6 | | " | 15 | 135 | 1.20 | 67 | Present Invention |
| 7 | 7 | | " | 12 | 135 | 1.21 | 70 | Present Invention |

*) The relative sensitivity is relatively represented assuming that the sensitivity of the coating sample 1 is 100.
**) The rate of development is represented by a relative value of sensitivity of 2-min development assuming that the sensitivity of 8-min development of each sample is 100.

As is apparent from Table 3, as compared with the samples 1 to 3 respectively consisting of the emulsions 1 to 3 as comparative examples, surprising improvements were found in photographic and development properties such as relative sensitivity and a gamma in each of the samples 4 to 7 respectively consisting of the emulsions 4 to 7 of the present invention, thereby the significant effect of the present invention was confirmed.

EXAMPLE 2

(Formation of Sample 201)

A multilayered color light-sensitive material constituted by layers having the following compositions was formed on an undercoated 127 μm thick triacetylcellulose film support, thereby obtaining a sample 201. Numerals indicate an addition amount per $m^2$. Note that the effects of the added compounds are not limited to those described here.

Formulas of the compounds are summarized in Table 4 (to be presented later).

| | |
|---|---|
| Layer 1: Antihalation layer | |
| Black colloidal silver | 0.25 g |
| Gelatin | 1.9 g |
| Ultraviolet absorbent U-1 | 0.04 g |
| Ultraviolet absorbent U-2 | 0.1 g |
| Ultraviolet absorbent U-3 | 0.1 g |
| Ultraviolet absorbent U-4 | 0.1 g |
| Ultraviolet absorbent U-6 | 0.1 g |
| High-boiling organic solvent Oil-1 | 0.1 g |
| Layer 2: Interlayer | |
| Gelatin | 0.40 g |
| Compound Cpd-D | 10 mg |
| High boiling organic solvent Oil-3 | 0.1 g |
| Dye D-4 | 0.4 mg |
| Layer 3: Interlayer | |
| Surface-fogged and internally fogged fine grain silver iodobromide emulsion (average grain size = 0.06 fm, variation coefficient = 18%, AgI content = 1 mol %) | silver 0.05 g |
| Gelatin | 0.4 g |
| Layer 4: Low-sensitivity red-sensitive emulsion layer | |
| Emulsion A | silver 0.1 g |
| Emulsion B | silver 0.4 g |
| Gelatin | 0.8 g |
| Coupler C-1 | 0.15 g |
| Coupler C-2 | 0.05 g |
| Coupler C-9 | 0.05 g |
| Compound Cpd-D | 10 mg |
| High-boiling organic solvent Oil-2 | 0.1 g |
| Layer 5: Medium-sensitivity red-sensitive emulsion layer | |
| Emulsion C | silver 0.5 g |
| Gelatin | 0.8 g |
| Coupler C-1 | 0.2 g |
| Coupler C-2 | 0.05 g |
| Coupler C-3 | 0.2 g |
| High-boiling organic solvent oil-2 | 0.1 g |
| Layer 6: High-sensitivity red-sensitive emulsion layer | |
| Emulsion D | silver 0.4 g |
| Gelatin | 1.1 g |
| Coupler C-1 | 0.3 g |
| Coupler C-3 | 0.7 g |
| Additive P-1 | 0.1 g |
| Layer 7: Interlayer | |
| Gelatin | 0.6 g |
| Additive M-1 | 0.3 g |
| Color-mixing inhibitor Cpd-K | 2.6 mg |
| Ultraviolet absorbent U-1 | 0.1 g |
| Ultraviolet absorbent U-6 | 0.1 g |
| Dye D-1 | 0.02 g |
| Layer 8: Interlayer | |
| Surface-fogged and internally fogged silver iodobromide emulsion (average grain size 0.06 μm, variation coefficient = 16%, AgI content 0.3 mol %) | silver 0.02 g |
| Gelatin | 1.0 g |
| Additive P-1 | 0.2 g |
| Color-mixing inhibitor Cpd-J | 0.1 g |
| Color-mixing inhibitor Cpd-A | 0.1 g |
| Layer 9: Low-sensitivity green-sensitive emulsion layer | |
| Emulsion E | silver 0.3 g |
| Emulsion F | silver 0.2 g |
| Gelatin | 0.5 g |
| Coupler C-7 | 0.05 g |
| Coupler C-8 | 0.20 g |
| Compound Cpd-B | 0.03 g |
| Compound Cpd-D | 10 mg |
| Compound Cpd-E | 0.02 g |
| Compound Cpd-F | 0.02 g |
| Compound Cpd-G | 0.02 g |

-continued

| | |
|---|---|
| Compound Cpd-H | 0.02 g |
| High-boiling organic solvent Oil-1 | 0.1 g |
| High-boiling organic solvent Oil-2 | 0.1 g |
| Layer 10: Medium-sensitivity green-sensitive emulsion layer | |
| Emulsion F | silver 0.3 g |
| Emulsion G | silver 0.1 g |
| Gelatin | 0.6 g |
| Coupler C-7 | 0.2 g |
| Coupler C-8 | 0.1 g |
| Compound Cpd-B | 0.03 g |
| Compound Cpd-F | 0.02 g |
| Compound Cpd-G | 0.05 g |
| Compound Cpd-H | 0.05 g |
| High-boiling organic solvent Oil-2 | 0.01 g |
| Layer 11: Low-sensitivity green-sensitive emulsion layer | |
| Emulsion | silver 0.5 g |
| Gelatin | 1.0 g |
| Coupler C-4 | 0.3 g |
| Coupler C-8 | 0.1 g |
| Compound Cpd-B | 0.08 g |
| Compound Cpd-E | 0.02 g |
| Compound Cpd-F | 0.02 g |
| Compound Cpd-G | 0.02 g |
| Compound Cpd-H | 0.02 g |
| High-boiling organic solvent Oil-1 | 0.02 g |
| High-boiling organic solvent Oil-2 | 0.02 g |
| Layer 12: Interlayer | |
| Gelatin | 0.6 g |
| Dye D-1 | 0.1 g |
| Dye D-2 | 0.05 g |
| Dye D-3 | 0.07 g |
| Layer 13: Yellow filter layer | |
| Yellow colloidal silver | silver 0.1 g |
| Gelatin | 1.1 g |
| Color-mixing inhibitor Cpd-A | 0.01 g |
| High-boiling organic solvent Oil-1 | 0.01 g |
| Layer 14: Interlayer | |
| Gelatin | 0.6 g |
| Layer 15: Low-sensitivity blue-sensitive emulsion layer | |
| Emulsion I | silver 0.4 g |
| Emulsion J | silver 0.2 g |
| Gelatin | 0.8 g |
| Coupler C-5 | 0.6 g |
| Layer 16: Medium-sensitivity blue-sensitive emulsion layer | |
| Emulsion K | silver 0.4 g |
| Gelatin | 0.9 g |
| Coupler C-5 | 0.3 g |
| Coupler C-6 | 0.3 g |
| Layer 17: High-sensitivity blue-sensitive emulsion layer | |
| Emulsion 1 described in Example 1 | silver 0.4 g |
| Gelatin | 1.2 g |
| Coupler C-6 | 0.7 g |
| Layer 18: 1st protective layer | |
| Gelatin | 0.7 g |
| Ultraviolet absorbent U-1 | 0.04 g |
| Ultraviolet absorbent U-2 | 0.01 g |
| Ultraviolet absorbent U-3 | 0.03 g |
| Ultraviolet absorbent U-4 | 0.03 g |
| Ultraviolet absorbent U-5 | 0.05 g |
| Ultraviolet absorbent U-6 | 0.05 g |
| High-boiling organic solvent Oil-i | 0.02 g |
| Formaldehyde scavenger Cpd-C | 0.2 g |
| Formaldehyde scavenger Cpd-I | 0.4 g |
| Dye D-3 | 0.05 g |

-continued

| | |
|---|---|
| Layer 19: 2nd protective layer | |
| Colloidal silver | silver 0.1 mg |
| Fine grain silver iodobromide emulsion (average grain size = 0.06 fm, AgI content = 1 mol %) | silver 0.1 g |
| Gelatin | 0.4 g |
| Layer 20: 3rd protective layer | |
| Gelatin | 0.4 g |
| Polymethylmethacrylate (average grain size = 1.5 μm) | 0.1 g |
| copolymer of methylmethacrylate and acrylic acid in the mole ratio of 4:6 (average grain size = 1.5 μm) | 0.1 g |
| Silicone oil | 0.03 g |
| Surfactant W-1 | 3.0 mg |
| Surfactant W-2 | 0.03 g |

In addition to the above compositions, additives F-1 to F-8 were added to all of the emulsion layers. Furthermore, in addition to the above compositions, a gelatin hardener H-1 and surfactants W-3 and W-4 for coating and emulsification were added to each layer.

In addition, as antiseptic and mildew-proofing agents, phenol, 1,2-benzisothiazoline-3-one, 2-phenoxyethanol, and phenethyl alcohol were added. Silver iodobromide emulsions used in the sample 201 were as shown in Table 4.

TABLE 4

| Emulsion Name | Grain shape | Average grain size (μm) | Variation coefficient (%) | AgI content (%) |
|---|---|---|---|---|
| A | Monodisperse tetradecahedral grains | 0.25 | 16 | 3.7 |
| B | Monodisperse cubic grains | 0.35 | 10 | 3.3 |
| C | Monodisperse tabular grains, Average aspect ratio 4.0 | 0.47 | 18 | 5.0 |
| D | Monodisperse tabular grains, Average aspect ratio 4.0 | 0.68 | 16 | 2.0 |
| E | Monodisperse cubic grains | 0.20 | 16 | 4.0 |
| F | Monodisperse cubic grains | 0.35 | 11 | 3.5 |
| G | Monodisperse cubic grains | 0.45 | 9 | 3.5 |
| H | Monodisperse tabular grains, Average aspect ratio 7.0 | 0.80 | 13 | 1.5 |
| I | Monodisperse tetradecahedral grains | 0.30 | 18 | 4.0 |
| J | Monodisperse cubic grains | 0.40 | 14 | 3.5 |
| K | Monodisperse tabular grains, Average aspect ratio 7.0 | 0.55 | 13 | 3.5 |
| I | Tabular grains, Average aspect ratio 7.0 | 1.00 | 35 | 2.0 |

The sensitizing dyes were added as shown in the following table immediately before chemical sensitization of the emulsions A to K and 1. The sensitizing dyes S-1 to S-8 are listed in Table 12 (to be presented later).

| Emulsion Name | Added sensitizing dye | Addition amount per mol silver halide (m · mol) |
|---|---|---|
| A | S-1 | 0.44 |
| | S-2 | 0.04 |
| B | S-1 | 0.44 |
| | S-2 | 0.01 |
| C | S-1 | 0.26 |
| | S-2 | 0.02 |
| D | S-1 | 0.18 |
| | S-2 | 0.01 |
| | S-7 | 0.01 |
| E | S-3 | 0.47 |
| | S-4 | 0.15 |
| F | S-3 | 0.31 |
| | S-4 | 0.09 |

-continued

| Emulsion Name | Added sensitizing dye | Addition amount per mol silver halide (m · mol) |
|---|---|---|
| G | S-3 | 0.30 |
| | S-4 | 0.09 |

-continued

| Emulsion Name | Added sensitizing dye | Addition amount per mol silver halide (m · mol) |
|---|---|---|
| H | S-3 | 0.47 |
| | S-4 | 0.06 |
| | S-8 | 0.13 |
| I | S-6 | 0.27 |
| | S-5 | 0.07 |
| J | S-6 | 0.29 |
| | S-5 | 0.09 |
| K | S-6 | 0.50 |
| | S-5 | 0.15 |
| 1 | S-6 | 0.29 |
| | S-5 | 0.09 |

(Formation of Samples 202 to 207)

Samples 202 to 207 were formed following the same procedures as for the sample 201 except that the emulsions 2 to 7 were used in place of the emulsion 1 in the high-sensitivity blue-sensitive emulsion layer 17.

(Evaluation of Coating Samples)

Sample pieces of the coating samples 201 to 207 obtained as described above were subjected to white-light wedge exposure at an exposure amount of 20 CMS for an exposure time of 1/100 sec, and developed as described below, thereby performing sensitometry.

Processing Steps

| Process | Time | Temperature | Tank volume | Quantity of replenisher |
|---|---|---|---|---|
| Black and white development | 6 min. | 38° C. | 12 l | 2.2 l/m$^2$ |
| 1st washing | 2 min. | 38° C. | 4 l | 7.5 l/m$^2$ |
| Reversal | 2 min. | 38° C. | 4 l | 1.1 l/m$^2$ |
| Color Development | 6 min. | 38° C. | 12 l | 2.2 l/m$^2$ |
| Bleaching(B) | 3 min. | 38° C. | 6 l | 0.15 l/m$^2$ |
| Fixing | 4 min. | 38° C. | 8 l | 2.2 l/m$^2$ |
| 2nd Washing(1) | 2 min. | 38° C. | 4 l | . . . |
| 2nd Washing(2) | 2 min. | 38° C. | 4 l | 7.5 l/m$^2$ |
| Stabilization | 2 min. | 38° C. | 4 l | 1.1 l/m$^2$ |
| 3rd Washing | 1 min. | 38° C. | 4 l | 1.1 l/m$^2$ |

to a bath used in 2nd washing (1).

The compositions of the respective processing solutions were as follows.

Black and white developing solution

| | Mother solution | Replenisher |
|---|---|---|
| Pentasodium nitrilo-N,N,N-trimethylene phosphonate | 2.0 g | 2.0 g |
| Pentasodium diethylene-triamine pentaacetate | 3.0 g | 3.0 g |
| Potassium sulfite | 30.0 g | 30.0 g |
| Hydroquinone potassium monosulfonate | 20.0 g | 20.0 g |
| Potassium carbonate | 33.0 g | 33.0 g |
| 1-phenyl-4-methyl-4-hydroxymethyl-3-pyrazolidone | 2.0 g | 2.0 g |
| Potassium bromide | 2.5 g | 1.4 g |
| Potassium thiocyanate | 1.2 g | 1.2 g |
| Potassium iodide | 2.0 mg | 2.0 mg |
| Water to make | 1.0 l | 1.0 l |
| pH (25° C.) | 9.60 | 9.70 |

The pH was adjusted by hydrochloric acid or potassium hydroxide.

Reversal solution

| | Mother solution | Replenisher |
|---|---|---|
| Pentasodium nitrilo-N,N,N-trimethylene phosphonate | 3.0 g | the same as mother solution |

-continued

Reversal solution

| | Mother solution | Replenisher |
|---|---|---|
| Stannous chloride dehydrate | 1.0 g | |
| p-aminophenol | 0.1 g | |
| Sodium hydroxide | 8.0 g | |
| Glacial acetic acid | 15.0 ml | |
| Water to make | 1.0 l | |
| pH (25° C.) | 6.00 | |

The pH was adjusted by hydrochloric acid or sodium hydroxide.

Color developing solution

| | Mother solution | Replenisher |
|---|---|---|
| Pentasodium nitrilo-N,N,N-trimethylene phosphonate | 2.0 g | 2.0 g |
| Pentasodium diethylene-triamine pentaacetate | 2.0 g | 2.0 g |
| Sodium sulfite | 7.0 g | 7.0 g |
| Tripotassium phosphate dodecahydrate | 36.0 g | 36.0 g |
| Potassium bromide | 1.0 g | — |
| Potassium iodide | 90 mg | — |
| Sodium hydroxide | 3.0 g | 3.0 g |
| Citrazinic acid | 1.5 g | 1.5 g |
| N-ethyl-(β-methane-sulfonamidoethyl)-3-methyl-4aminoaniline sulfate | 10.5 g | 10.5 g |
| 3,6-dithiaoctane-1,8-diol | 3.5 g | 3.5 g |
| Water to make | 1.0 l | 1.0 l |
| pH (25° C.) | 11.90 | 12.05 |

The pH was adjusted by hydrochloric acid or potassium hydroxide.

| | Mother solution | Replenisher |
|---|---|---|
| Control solution | | |
| Water | 700 ml | the same as mother solution |
| Sodium sulfite | 12 g | |
| Sodium ethylene-diaminetetraacetate (dihydrate) | 8 g | |
| Thioglycerin | 0.4 ml | |
| Glacial acetic acid | 3 ml | |
| Water to make | 1,000 ml | |
| Bleaching solution | | |
| 1,3-diaminopropane tetraacetate | 2.8 g | 4.0 g |
| Ferric ammonium 1,3-diaminopropane tetraacetate monohydrate | 138.0 g | 207.0 g |
| Ammonium bromide | 80.0 g | 120.0 g |
| Ammonium nitrate | 20.0 g | 30.0 g |
| Hydroxy acetate | 50.0 g | 75.0 g |
| Acetic acid | 50.0 g | 75.0 g |
| Water to make | 1.0 l | 1.0 l |

-continued

| | Mother solution | Replenisher |
|---|---|---|
| pH (25° C.) | 3.40 | 2.80 |

The pH was adjusted by acetic acid or ammonia water.

| | Mother solution | Replenisher |
|---|---|---|
| Fixing solution | | |
| Disodium ethylene-diamine tetraacetate dihydrate | 1.7 g | the same as mother solution |
| Sodium benzaldehyde-o-sulfonate | 20.0 g | |
| Sodium bisulfite | 15.0 g | |
| Ammonium thiosulfate (700 g/l) | 340.0 ml | |
| Imidazole | 28.0 g | |
| Water to make | 1.0 l | |
| pH (25° C.) | 4.00 | |
| The pH was adjusted by acetic acid or ammonia water. | | |
| Stabilizing Solution | | |
| Disodium ethylene-diamine tetraacetate dihydrate | 1.0 g | the same as mother solution |
| Sodium carbonate | 6.0 g | |
| Compound A* | 0.05 mol | |
| Water to make | 1.0 l | |
| pH (25° C.) | 7.50 | |

The pH was adjusted by acetic acid or sodium hydroxide.

Compund A*

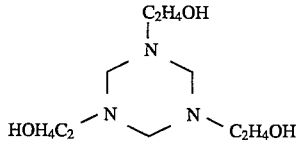

| 3rd washing solution | Mother Solution | Replenisher |
|---|---|---|
| Disodium ethylene-diamine tetraacetate dehydrate | 0.2 g | the same as mother solution |
| hydroxyethylidene-1,1-diphosphonic acid | 0.05 g | |
| Ammonium acetate | 2.0 g | |
| Sodium dodecylbenzene-sulfonate | 0.3 g | |
| pH (25° C.) | 4.50 | |

The pH was adjusted by acetic acid or ammonia water.

The color reversal sensitivity of the high-sensitivity blue-sensitive layer 17 was estimated on the basis of a relative exposure amount larger by 2.5 than the minimum yellow density. As a result, each of the samples 204 to 207 respectively containing the emulsions 4 to 7 of the present invention had a sensitivity higher by 10% or more than those of the samples 201 to 203 respectively containing the emulsions 1 to 3 as comparative examples, thereby the effect of the present invention could be confirmed

EXAMPLE 3

(1) Preparation of Emulsion

Preparation of emulsion 301

27.5 cc of each of an aqueous $AgNO_3$ solution (containing 32 g of $AgNO_3$, 0.7 g of gelatin having an average molecular weight (M) of 20,000, and 0.14 ml of $HNO_3$(1N) in 100 ml) and an aqueous KBr solution (containing 0.7 g of gelatin having $\overline{M}$/ of 20,000 in 100 lm) were added by the double jet method to 1 l of an aqueous solution containing 4.5 g of KBr and 7 g of gelatin having $\overline{M}$ of 20,000 under stirring at a rate of 25 cc/min, while a pBr value was maintained constant. The temperature of the solutions along the addition was 30° C. 350 ml of the resultant emulsion were extracted as a seed crystal and added with 650 ml of an aqueous gelatin solution (containing 20 g of gelatin and 1.2 g of KBr). The temperature of the resultant solution was increased to 75° C., and ripening was performed for 40 minutes. Thereafter, an aqueous $AgNO_3$ solution (containing 1.7 g of $AgNO_3$) was added over one minute 30 seconds, and 6.2 ml of an aqueous $NH_4NO_3$ (50 wt. %) solution and 6.2 ml of an aqueous $NH_3$ (25 wt. %) solution were added to perform ripening for another 40 minutes. The resulting emulsion was adjusted to have a pH of 7.0, and 1 g of KBr was added. Subsequently, an aqueous $AgNO_3$ solution (containing 10 g of $AgNO_3$ in 100 ml) and an aqueous KBr solution were added by CDJ at a silver potential of −20 mV and a rate of 8 ml/min. for first 10 minutes and 15 ml/min. for next 20 minutes. The resultant emulsion was washed with water and redispersed. A replica image of the obtained emulsion grains was observed by a TEM (magnification= x3,280). The average grain size of the grains of the present invention contained in the emulsion was 1.1 μm, their average thickness was 0.16 μm, and their average aspect ratio was 6.7. Other characteristics are shown in Table 5 and 6.

Preparation of emulsion 302

When addition of 80% of the total $AgNO_3$ amount was finished in the preparation of the emulsion 301, addition of the aqueous $AgNO_3$ and KBr solutions was interrupted, and 830 ml of an aqueous KI solution were then added at a temperature of 50° C. over about 10 seconds, thus preparing emulsion 302.

In this case, immediately before the addition of the aqueous KI solution, an aqueous KBr solution was added and the silver potential wan adjusted to be −60 mv.

Preparation of emulsions 303, 304, and 305

In the preparation of emulsion 302, the amount of the aqueous KBr solution added before the addition of the aqueous KI solution was reduced and the silver potential was adjusted to be −50 mV, −3 mV, and −20 mV, thereby preparing emulsion 303, 304, and 305, respectively.

Preparation of emulsions 306, 307, 308

In the preparation of emulsion 302, the amount of the aqueous KI solution added was reduced from 830 ml to 620 ml, 410 ml, and 205 ml, thus preparing emulsions 306, 307, 308, respectively.

Preparation of emulsions 309, 310, 311

In the preparation of emulsion 302, the temperature at the first addition of $AgNO_3$ was changed from 30° C. to 45° C., 60° C., and 75° C., thereby preparing emulsions 309, 310, and 311, respectively.

Preparation of emulsions 312, 313, and 314

In the preparation of emulsion 302, the ripening temperature and time were changed from 75° C. for 40 minutes to 60° C. for 40 minutes, 50° C. for 40 minutes, and 50° C. for 20 minutes, thus preparing emulsions 312, 313, and 314, respectively.

TABLE 5

| Emulsion | Projected area (%) accounted for by grains having aspect ratio of 3 or more | Relative standard deviation (%) in grain size distribution | Ratio (%) grains 10 or more dislocations | Relative standard deviation in intergranular iodide distribution |
|---|---|---|---|---|
| Comparative Example 301 | 99.7 | 10.1 | 3 | 0 |
| Present Invention 302 | 87.6 | 15.2 | 82 | 12 |
| Present Invention 303 | 88.3 | 16.3 | 80 | 19 |
| Present Invention 304 | 82.3 | 18.1 | 84 | 26 |
| Comparative Example 305 | 78.5 | 20.3 | 87 | 35 |
| Present Invention 306 | 88.3 | 14.2 | 75 | 12 |
| Present Invention 307 | 89.5 | 13.1 | 62 | 10 |

TABLE 6

| Emulsion | Projected area (%) accounted for by grains having aspect ratio of 3 or more | Relative standard deviation (%) in grain size distribution | Ratio (%) grains 10 or more dislocations | Relative standard deviation in intergranular iodide distribution |
|---|---|---|---|---|
| Comparative Example 308 | 94.3 | 11.2 | 45 | 8 |
| Present Invention 309 | 80.4 | 22.5 | 80 | 12 |
| Present Invention 310 | 78.5 | 28.3 | 83 | 14 |
| Present Invention 311 | 75.3 | 35.6 | 82 | 16 |
| Present Invention 312 | 75.3 | 14.2 | 79 | 13 |
| Present Invention 313 | 60.6 | 14.7 | 77 | 11 |
| Present Invention 314 | 45.8 | 15.2 | 79 | 10 |

(2) Manufacture and Evaluation of Coated Samples

Dodecylbenzenesulfonate as a coating aid, p-vinylbenzenesulfonat as a thickening agent, a vinylsulfone type compound as a film hardener, and a polyethyleneoxid type compound as a photographic property modifier were added to each of the emulsions 301 to 314 obtained in item (1) above, thereby preparing emulsion coating solutions. Subsequently, these coating solutions were separately, uniformly coated on undercoated polyester bases, and a surface protective layer consisting primarily of an aqueous gelatin solution was coated on them, thus manufacturing coated samples 301 to 314. In each of the samples 301 to 314, the coating silver amount was 4.0 g/m$^2$, the gelating coating amount of the protective layer was 1.3 g/m$^2$, and the gelatin coating amount of the emulsion layer was 2.7 g/m$^2$.

The following experiment was conducted in order to evaluate the coated samples thus manufactured.

First, sample pieces of the coated samples 301 to 314 were wedge-exposed with an exposure amount of 10 CMS for an exposure time of 1/100 sec., and developed with a processing solution having the following composition at 20° C. for four minutes. Subsequently, after fixing, washing, and drying the samples, sensitometry was performed to obtain sensitivity from the reciprocal of an exposure amount which yielded a density of fog +0.1. In addition, a gamma was calculated from the inclination of a straight line connecting points D=0.2 and D=1.0 on the characteristic curve. Next, two sample pieces were prepared for each of the coated samples 301 to 314 and subjected to the wedge exposure under the same exposure conditions as above. Thereafter, one of the sample pieces was developed with a processing solution at 20° C. for two minutes immediately after the exposure. The other sample piece was preserved at a temperature of 50° C. and a humidity of 55% for three days and then developed with the same processing solution under the same conditions. After fixing, washing, and drying, sensitometry was performed to obtain sensitivity from the reciprocal of an exposure amount which yielded a density of fog +0.1 in each development, thereby evaluating the shelf stability.

| Processing solution | |
|---|---|
| 1-phenyl-3-pyrazolidone | 0.5 g |
| Hydroquinone | 10 g |
| Disodium ethylenediamine tetraacetate | 2 g |
| Potassium sulfite | 60 g |
| Boric acid | 4 g |
| potassium cabonate | 20 g |
| Sodium bromide | 5 g |
| Diethyleneglycol | 20 g |
| Sodium hydroxide to adjust pH to be | 10.0 |
| Water to make | 1 l |

The obtained results are summarized in Table 7.

TABLE 7

| Sample | Gradation | Change in sensitivity after preservation at temperature of 50° C. and humidity of 55% for 3 days |
|---|---|---|
| Comparative Example 301 | 0.80 | 0.20 |
| Present Invention 302 | 1.25 | 0.02 |
| Present Invention 303 | 1.20 | 0.03 |
| Present Invention 304 | 1.19 | 0.02 |
| Comparative Example 305 | 1.02 | 0.02 |
| Present Invention 306 | 1.23 | 0.03 |
| Present Invention 307 | 1.20 | 0.05 |
| Comparative Example 308 | 1.16 | 0.12 |
| Present Invention 309 | 1.10 | 0.02 |
| Present Invention 310 | 1.04 | 0.04 |

TABLE 7-continued

| Sample | Gradation | Change in sensitivity after preservation at temperature of 50° C. and humidity of 55% for 3 days |
|---|---|---|
| Present Invention 311 | 0.98 | 0.03 |
| Present Invention 312 | 1.19 | 0.05 |
| Present Invention 313 | 1.05 | 0.07 |
| Present Invention 314 | 0.85 | 0.10 |

Tables 5, 6 and 7 reveal the following findings.

① The number of grains in which dislocations are found tends to increase in order of the emulsions 303, 304 and 305 compared with the emulsion 302, but an intergranular iodide distribution is widened to result in a soft tone in gradation.

② Although the intergranular iodide distribution is narrowed in order of the emulsions 306, 307, and 308, a ratio of grains having dislocations decreases, and this results in extreme deterioration in latent image shelf stability.

③ The granular size distribution is widened in order of the emulsion 309, 310, and 311, resulting in a soft tone in gradation.

④ A ratio accounted for by grains having an aspect ratio of 3 or more is reduced in order of the emulsions 312, 313, and 314, so that a soft tone is found in gradation.

⑤ An emulsion in which almost no dislocations are found is unpreferable in terms of both a soft tone in gradation and latent image shelf stability.

EXAMPLE 4

(1) Preparation of Emulsion 6 g of potassium bromide and 30 g of inert gelatin were dissolved in 3.7 l of distilled water, and a 14% aqueous potassium bromide solution and a 20% aqueous silver nitrate solution were added by a double jet method to the resultant aqueous solution under sufficient stirring at predetermined flow rates overone minute. The temperature of the resultant aqueous solution was 55° C., and the pAg thereof was 9.6, along the addition. (in this addition (I), 2.40% of a total silver amount were consumed). Thereafter, an aqueous gelatin solution (17%, 300 cc) was added, and the resulting solution was stirred at 55° C. A 20% aqueous silver nitrate solution was then added at a predetermined flow rate until the pAg reached 8.40 (in this addition (II), 5.0% of the total silver amount were consumed). Next, the temperature was increased to 75° C., and 35 cc of a 25% aqueous $NH_3$ solution were added. After the resultant solution was held at this temperature for 15 minutes, 510 cc of 1N $H_2SO_4$ were added to neutralize the solution.

In addition, a 20% potassium bromide solution containing potassium iodide and a 33% aqueous silver nitrate solution were added by the double jet method over 80 minutes such that an addition amount of the potassium iodide was 8.3 g (in this addition (III), 92.6% of the total silver amount were consumed). During the addition (III), the temperature and the pAg were held at 75° C. and 8.10, respectively. The silver nitrate amount used in this emulsion was 425 g. Subsequently, after a desalting was performed in accordance with a conventional flocculation method, sulfur-plus-gold sensitization was optimally performed in the presence of sensitization dyes S-5 and S-6, thereby preparing a tabular AgBrI (AgI=2.0 mol %) emulsion 401 for comparison.

An emulsion 402 for comparison was prepared following the same procedures as for the emulsion 401 except that potassium iodide was removed from the halogen solution used in the addition (III), and that when 40% of the total silver amount were consumed during the addition (III), the addition of the silver nitrate and potassium bromide solutions was interrupted, 830 ml of a 1% aqueous potassium iodide solution was added over 90 seconds, and the flow rate in the rest of the addition (III) was tripled.

An emulsion 403 of the present invention was prepared following the same procedures as for the emulsion 402 expect that the temperature was decreased to 50° C. immediately before the addition of the aqueous potassium iodide solution, and an aqueous potassium more of the grains. Dislocation lines tended to be observed uniformly between the grains in the emulsions 403 and 404 compared with the emulsion 402.

A relative standard deviation (to be referred to as an intergranualr iodide distribution hereinafter) of a silver iodide content was calculated for each of the emulsions 401 to 404 in accordance with the method described in European Patent 147,868A. The result is shown in Table 8.

TABLE 8

| Emulsion | 401 | 402 | 403 | 404 |
|---|---|---|---|---|
| Intergranualr iodide distribution (%) | 20 | 65 | 12 | 12 |

(2) Manufacture and Evaluation of Coated Samples

Dodecylbenzenesulfonate as a coating aid, p-vinylbenzenesulfonate as a thicknening agent, a vinylsuflone type compound as a film hardener, and a polyethyleneoxide type compound as a photographic property modifier were added to each of the emulsions 401 to 404 obtained in item (1) above, thereby preparing emulsion coating solutions. Subsequently, these coating solutions were separately, uniformly coated on undercoated polyester bases, and a surface protective layer consisting primarily of an aqueous gelatin solution was coated on them, thus manufacturing coated samples 1 to 3 having the emulsions 401 to 403 for comparison and a coated sample 4 having the emulsion 404 of the present bromide solution was added to adjust the temperature and the pAg to 50° C. and 9.4, respectively.

An emulsion 404 of the present invention was prepared as follows. That is, in the preparation procedures for the emulsion 403, the addition of the silver nitrate and potassium bromide solutions in the addition (III) was stopped when 90% of the total silver amount of the emulsion 403 were added, and the desalting and the gold-plus-sulfur sensitization were similarly performed. Thereafter, a chemically unsensitized fine grain silver bromide emulsion (grain size=0.05 μm) was added in an amount corresponding to 10% of a silver amount. The resultant emulsion was stirred at 63° C. for 20 minutes, thereby preparing the emulsion 404.

In the emulsions 401 to 404 thus prepared, 98% of all grains were tabular grains. The equivalent sphere diameters of the grains of the all emulsions were equally 1.0 μm, and the average grain diameter/grain thickness ratio ranged from 6.5 to 7.0.

The emulsions 401 to 404 were subjected to observation of the direction dislocation by using a transmission electron microscope in accordance with the method described in Example I-(2) of JA-a-63-220238. As a result, no dislocations were observed in the emulsion 401. However, in each of the emulsions 402 to 404, to or more dislocation lines wee found in 50% (number) or invention. In each of the samples 401 to 404, the coating silver amount was 4.0 g/m$^2$, the gelatin coating amount of the protective layer was 1.3 g/m$^2$, and the gelatin coating amount of the emulsion layer was 2.7 g/m$^2$.

The following experiment was conducted in order to evaluate the coated samples thus manufactured.

First, sample pieces of the coated samples 401 to 404 were wedge-exposed with white light and developed with developers A and C shown in Table 9 below at 25° C. for five minutes to perform sensitometry, thereby obtaining relative sensitivity of the latter with respect to the former. The result is shown in Table 10.

It turns out that each of the emulsions 401 to 403 is a surface latent image type emulsion with which sensitivity obtained when development is performed using the developer A is higher than that obtained when development is performed using the developer C. By contrast, the emulsion 404 is an internal latent image type emulsion with which sensitivity obtained when development is performed using the developer C is higher than that obtained when development is performed using the developer A.

TABLE 9

| | Developer A (pH = 9.6) | Developer C (pH = 9.6 |
|---|---|---|
| N-methyl-p-aminophenol sulfate | 2.5 g | 2.5 g |
| Sodium ascorbate | 10.0 g | 10.0 g |
| Potassium metaborate | 35.0 g | 35.0 g |
| Potassium bromide | 1.0 g | 1.0 g |
| Sodium thiosulfate pentagydride | — | 2.0 g |
| Water to make | 1.0 1 | 1.0 1 |

TABLE 10

| Emulsion Name | Relative sensitivity obtained when developmentis performed using developer C with respect to that obtained when development is performed using developer A |
|---|---|
| 401 | 50 |
| 402 | 80 |
| 403 | 90 |
| 405 | 300 |

(Note 1) The sensitivity is obtained as the reciprocal of an exposure amount which yields a density of fog plus 0.1.

Next, the sample pieces of the coated samples 401 to 404 were wedge-exposed for an exposure time of 1/100 sec. and developed with a processing solution having the following composition at 20° C. for four minutes. subsequently, after fixing, washing, and drying were performed, sensitometry was performed to obtain sensitivity from the reciprocal of an exposure amount which yielded a density of fog +0.1. The obtained results are summarized in Table 11.

TABLE 11

| | Coating Sample No. | Emulsion No. | Presence/ absence of dislocation | Intergranular iodide distribution | Formation position of latent image | Photographic Properties 1) Relative sensitivity | Gamma | 2) Rate of development |
|---|---|---|---|---|---|---|---|---|
| Comparative Example | 401 | 401 | Absent | 20 | Surface | 100 | 0.08 | 50 |
| Comparative Example | 402 | 402 | Present | 65 | " | 123 | 1.12 | 54 |
| Present Invention | 403 | 403 | " | 12 | " | 135 | 1.20 | 67 |
| Present Invention | 404 | 404 | " | 12 | Interior | 141 | 1.27 | 43 |

1) The relative sensitivity is represented relatively assuming that the sensitivity of the coated sample 401 is 100.
2) The rate of development of each sample is represented by a relative value of the sensitivity of the sample obtained for a development time of two minutes assuming that its sensitivity obtained for a development time of eight minutes is 100

As is apparent from Table 11, the sample 403 of present invention is superior to those of Comparative Examples 401 and 402 in terms of photographic properties, i.e., sensitivity and gamma. However, the samples 403 is poor in the rate of development, that is, its relative sensitivity in the initial stage of development is high. However, the sample 404 of the present invention is significantly improved in this rate of development, and is further improved in the photographic properties, sensitivity and gamma, and this proves that the effect of the present invention is notable.

Additional advantages and modifications will readily occur to those skilled in the art. Therefore, the invention in its broader aspects is not limited to the specific details, and illustrated examples shown and described herein. Accordingly, various modifications may be made without departing from the spirit or scope of the general inventive concept as defined by the appended claims and their equivalents.

TABLE 12

C-1

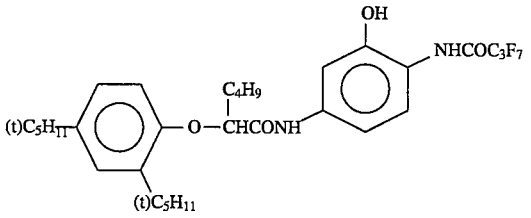

C-2

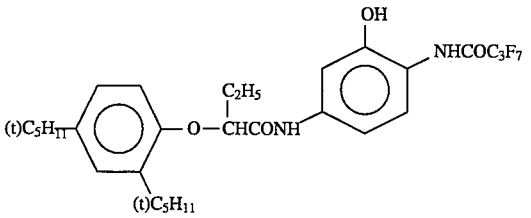

C-3

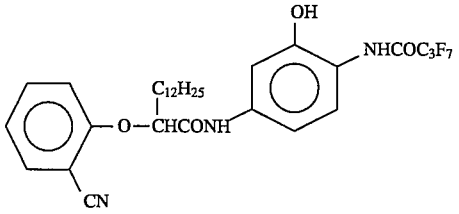

TABLE 12-continued

C-4

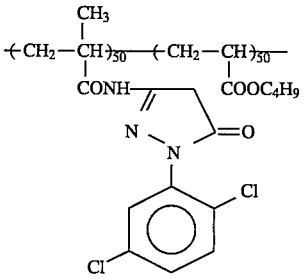

• Numerals represent wt %
• Average molecular weight: about 25,000

C-5

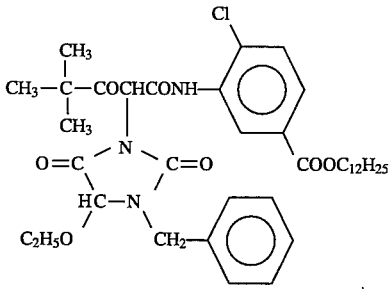

C-6

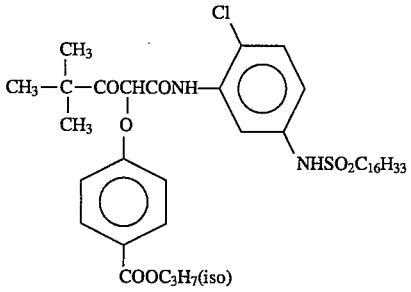

TABLE 12-continued
C-7
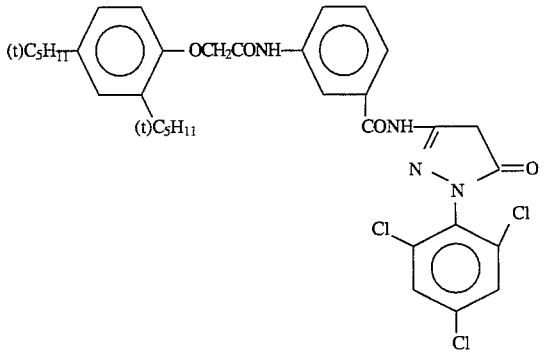
C-8
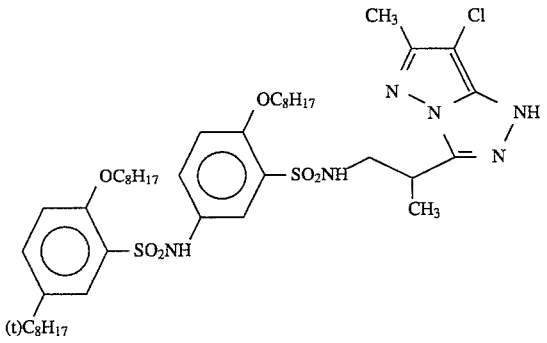
C-9
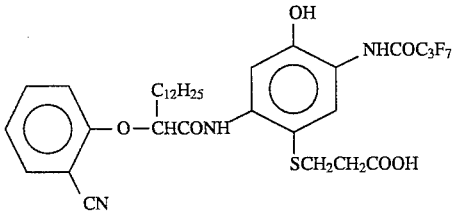
Dibutyl phthalate — Oil-1
Tricresyl phosphate — Oil-2
Oil-3
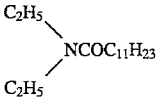
Cpd-A
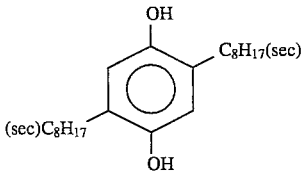
Cpd-B
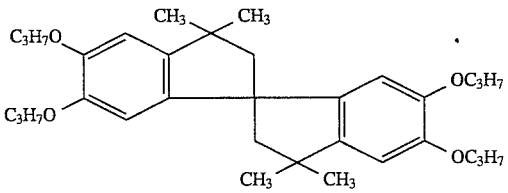
Cpd-C
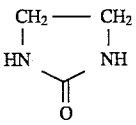
TABLE 12-continued
Cpd-D
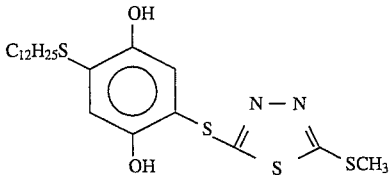
Cpd-E
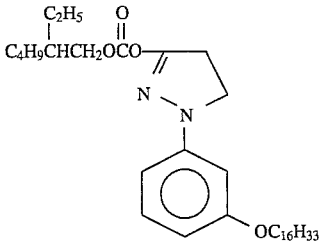
Cpd-F
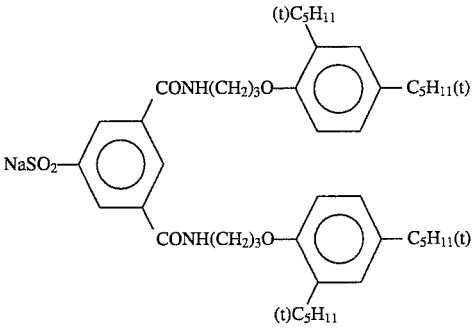
Cpd-G
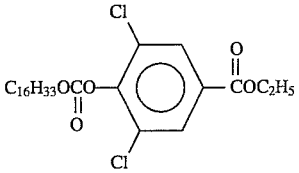
Cpd-H
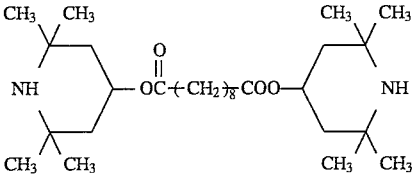
Cpd-I
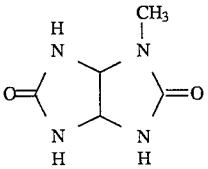
Cpd-J
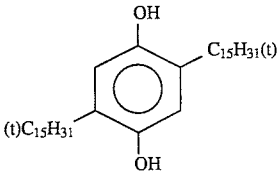

TABLE 12-continued
Cpd-K
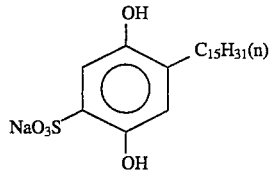
U-1
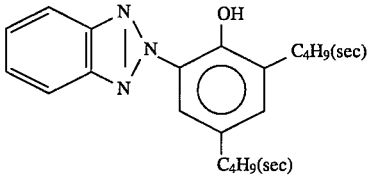
U-2
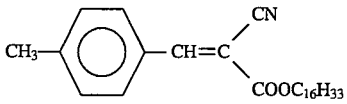
U-3
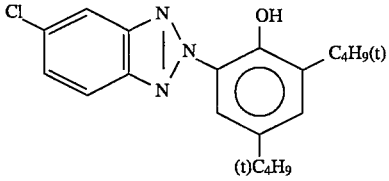
U-4
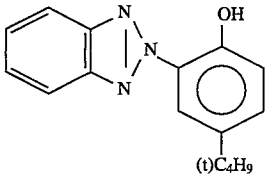
U-5
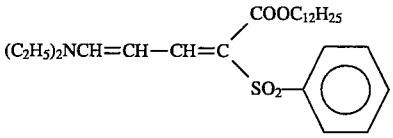
U-6
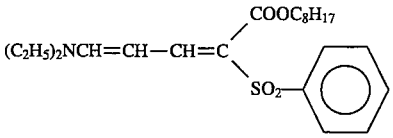
S-1
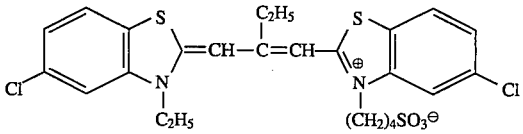
S-2
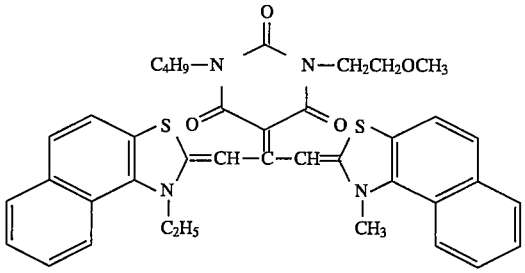
TABLE 12-continued
S-3
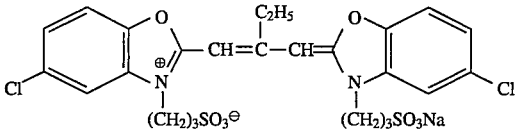
S-4
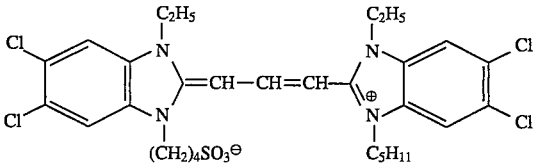
S-5
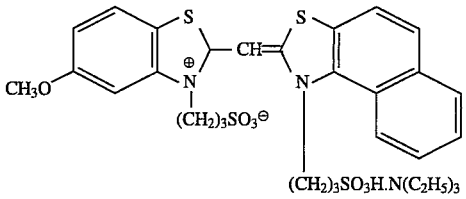
S-6
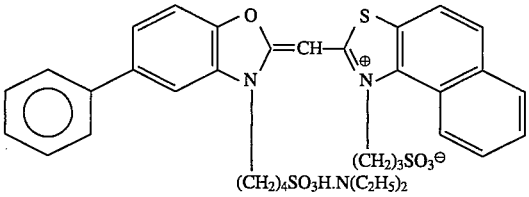
S-7
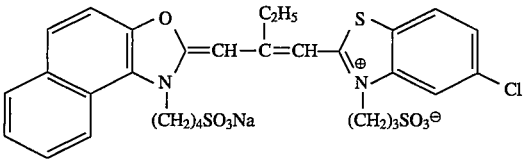
S-8
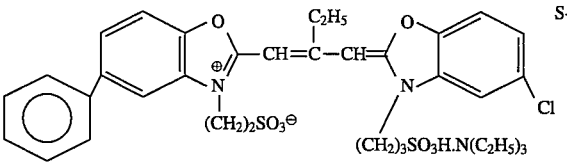
D-1
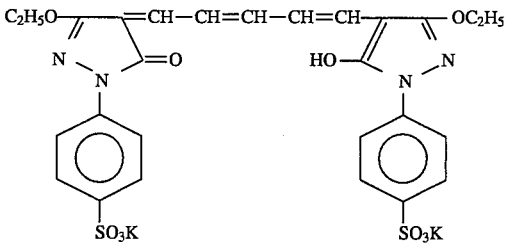

TABLE 12-continued
D-2
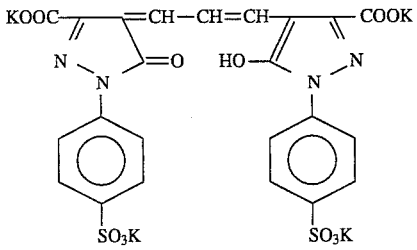
D-3
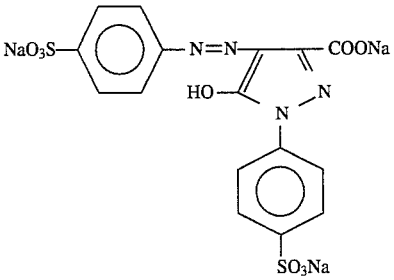
D-4
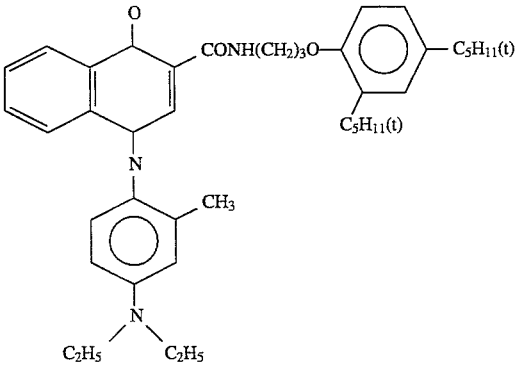
H-1
$CH_2{=}CH{-}SO_2{-}CH_2{-}CONH{-}CH_2$
$CH_2{=}CH{-}SO_2{-}CH_2{-}CONH{-}CH_2$
W-1
$C_8F_{17}SO_2NHCH_2CH_2OCH_2CH_2\overset{\oplus}{N}(CH_3)_3$
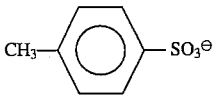
W-2
$C_8F_{17}SO_2N(C_3H_7)CH_2COOK$
W-3
$NaO_3S{-}CH(CH_2COOCH_2CH(C_2H_5)C_4H_9)COOCH_2CH(C_2H_5)C_4H_9$
W-4
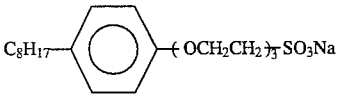
P-1
$\text{-}(CH_2{-}CH)_n\text{-}$
$CONHC_4H_9(t)$
M-1
$\text{-}(CH_2{-}CH)_n\text{-}$
$COOC_4H_9$
TABLE 12-continued
F-1
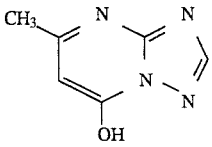
F-2
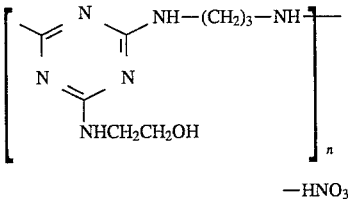
F-3
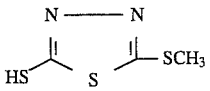
F-4
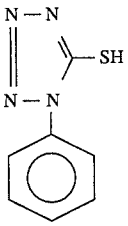
F-5
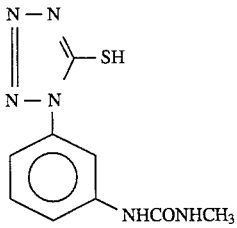
F-6
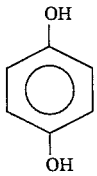
F-7
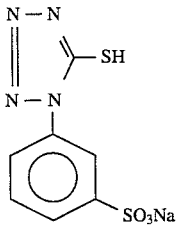
F-8
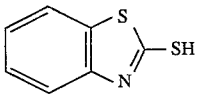

What is claimed is:

1. A light-sensitive silver halide emulsion comprising tabular silver halide grains having a thickness of less than 0.5 μm, a diameter of not less than 0.3 μm, and a grain diameter/grain thickness ratio of not less than 2, wherein said tabular silver halide grains account for at least 50% of a total projected area of all silver halide grains, not less than 50% (number) of said tabular silver halide grains include not less than dislocations per grain, a relative standard deviation of silver iodide content of individual tabular silver halide grains is not more than 30%, and said tabular grains contain 1–5 mol percent of silver iodide.

2. The emulsion according to claim 1, wherein each of said tabular silver halide grains internally has a portion where a silver iodide content is higher than that on the surface of the grain.

3. The emulsion according to claim 1, wherein a relative standard deviation in a grain size distribution of said tabular silver halide grains is not more than 25%.

4. The emulsion according to claim 1, wherein said tabular silver halide grains contained in said emulsion comprise negative silver halide grains, each of which forms a latent image in an interior of the grains.

5. The emulsion according to claim 1, wherein the grain diameter/grain thickness ratio is 2 to 12.

6. The emulsion according to claim 1, wherein the grain thickness is 0.08 to 0.3 μm.

7. The emulsion according to claim 1, wherein the tabular silver halide grains are silver iodobromide or silver chloroiodobromide grains.

8. The emulsion according to claim 1, wherein 80 percent (number) or more of the tubular grains include 10 or more dislocations per grain.

9. A photographic light-sensitive material having at least one silver halide emulsion layer on a support, wherein said silver halide emulsion layer contains a light-sensitive silver halide emulsion comprising tabular silver halide grains having a thickness of less than 0.5 μm, a diameter of not less than 0.3 μm, and a grain diameter/grain thickness ratio of not less than 2, in which said tabular silver halide grains account for at least 50% of a total projected area of all silver halide grains, not less than 50% (number) of said tabular silver halide grains include not less than 10 dislocations per grain, and a relative standard deviation of silver iodide content of individual tabular silver halide grains is not more than 30%, and said tabular grains contain 1–5 mol percent of silver iodide.

10. A material according to claim 9, wherein each of said tabular silver halide grains internally has a portion where a silver iodide content is higher than that on the surface of the grain.

11. The material according to claim 9, wherein a relative standard deviation in a grain size distribution of said tabular silver halide grains is not more than 25%.

12. The material according to claim 9, wherein said tabular silver halide grains contained in said light-sensitive silver halide emulsion comprise negative silver halide grains, each of which forms a latent image in an interior of the grains.

13. The material according to claim 9, wherein the grain diameter/grain thickness ratio is 2 to 12.

14. The material according to claim 9, wherein the grain thickness is 0.08 to 0.3 μm.

15. The material according to claim 9, wherein the tabular silver halide grains are silver iodobromide or silver chloroiodobromide grains.

16. The material according to claim 9, wherein the silver iodide content of the tabular grains is 0.1 to 20 mol percent.

17. The material according to claim 9, wherein 80 percent (number) or more of the tabular grains include 10 or more dislocations per grain.

18. The material according to claim 9, wherein the relative standard deviation of silver iodide content of individual tabular silver halide grains is 20 percent or less.

19. A light-sensitive silver halide emulsion comprising tabular silver halide grains having a thickness of less than 0.5 μm, a diameter of not less than 0.3 μm, and a grain diameter/grain thickness ratio of not less than 2, wherein said tabular silver halide grains account for at least 50% of a total projected area of all silver halide grains, not less than 50% (number) of said tabular silver halide grains include not less than 10 dislocations per grain, a relative standard deviation of silver iodide content of individual tabular silver halide grains is not more than 20%, and said tabular grains contain 1–5 mol percent of silver iodide.

* * * * *